US008348818B2

(12) United States Patent
Mierzejewski et al.

(10) Patent No.: US 8,348,818 B2
(45) Date of Patent: Jan. 8, 2013

(54) MACHINE FOR PRODUCING PACKAGING CUSHIONING

(75) Inventors: Kenneth J. Mierzejewski, Harwinton, CT (US); David Seebauer, Southington, CT (US)

(73) Assignee: Sealed Air Corporation (US), Elmwood Park, NJ (US)

( * ) Notice: Subject to any disclaimer, the term of this patent is extended or adjusted under 35 U.S.C. 154(b) by 418 days.

(21) Appl. No.: 12/788,423

(22) Filed: May 27, 2010

(65) Prior Publication Data

US 2011/0295409 A1 Dec. 1, 2011

(51) Int. Cl.
*B31B 1/00* (2006.01)

(52) U.S. Cl. ..... 493/30; 493/34; 493/352

(58) Field of Classification Search ..... 493/30, 493/34, 13–15, 352, 350, 904, 967
See application file for complete search history.

(56) References Cited

U.S. PATENT DOCUMENTS

| | | | | |
|---|---|---|---|---|
| 2,924,154 | A | 2/1960 | Russell et al. | |
| 3,719,357 | A | 3/1973 | Shields | |
| 3,910,567 | A | 10/1975 | Songer | |
| 4,155,545 | A | 5/1979 | Yanagawa et al. | |
| 4,607,252 | A * | 8/1986 | Neri | 340/515 |
| 4,721,297 | A | 1/1988 | Katayama et al. | |
| 4,801,134 | A | 1/1989 | Yokoyama et al. | |
| 4,815,669 | A | 3/1989 | Fujii et al. | |
| 4,842,205 | A | 6/1989 | Araki et al. | |
| 4,934,686 | A | 6/1990 | Ono et al. | |
| 4,968,291 | A | 11/1990 | Baldacci et al. | |
| 4,986,481 | A | 1/1991 | Fujii et al. | |
| 5,009,410 | A | 4/1991 | Fujii et al. | |
| 5,056,604 | A | 10/1991 | Garavuso | |
| 5,088,972 | A | 2/1992 | Parker | |
| 5,123,887 | A * | 6/1992 | Shimura | 493/34 |
| 5,134,013 | A | 7/1992 | Parker | |
| 5,145,160 | A | 9/1992 | Nagashima et al. | |
| 5,167,604 | A * | 12/1992 | Ohsawa | 493/23 |
| 5,173,352 | A | 12/1992 | Parker | |
| 5,192,068 | A | 3/1993 | Parker et al. | |
| 5,213,319 | A | 5/1993 | Crowe et al. | |
| 5,228,673 | A | 7/1993 | Osonoe et al. | |
| 5,362,002 | A | 11/1994 | Tsai | |
| 5,387,173 | A | 2/1995 | Simmons, Jr. | |
| 5,571,067 | A * | 11/1996 | Ratzel | 493/30 |
| 5,624,108 | A | 4/1997 | Kubo | |
| 5,695,184 | A | 12/1997 | Miller et al. | |
| 5,712,020 | A | 1/1998 | Parker | |
| 5,772,129 | A | 6/1998 | Nishio et al. | |

(Continued)

FOREIGN PATENT DOCUMENTS

JP S38-2011 B 3/1963

*Primary Examiner* — Sameh H. Tawfik
(74) *Attorney, Agent, or Firm* — Thomas C. Lagaly

(57) ABSTRACT

A machine for producing packaging cushioning generally includes a first feed mechanism for successively feeding sheets of a substrate at a first speed, the first feed mechanism including a motor and a power supply therefor, a second feed mechanism for receiving the sheets from the first feed mechanism and feeding the sheets at a second speed, a control unit for controlling at least one of the first and second speeds to produce a desired degree of overlap between successive sheets, and a sensor to measure the amount of electricity drawn by the motor. The control unit modulates the amount of electricity that the motor draws from a power supply when a signal from the sensor has a value that is greater than or equal to a predetermined value.

15 Claims, 14 Drawing Sheets

U.S. PATENT DOCUMENTS

| | | | |
|---|---|---|---|
| 5,842,694 | A | 12/1998 | Brooks et al. |
| 5,944,430 | A | 8/1999 | Myung |
| 6,017,299 | A | 1/2000 | Ratzel |
| 6,027,110 | A | 2/2000 | Herrmann et al. |
| 6,053,324 | A | 4/2000 | Weder |
| 6,168,847 | B1 | 1/2001 | Murphy et al. |
| 6,189,297 | B1 | 2/2001 | Weder |
| 6,286,827 | B1 | 9/2001 | Meetze, Jr. et al. |
| 6,385,949 | B2 | 5/2002 | Weder |
| 6,436,511 | B1 | 8/2002 | Ratzel |
| 6,471,154 | B1 | 10/2002 | Toth |
| 6,532,721 | B1 | 3/2003 | Weder |
| 6,546,701 | B2 | 4/2003 | Weder et al. |
| 6,610,001 | B1 | 8/2003 | Harding et al. |
| 6,659,449 | B2 | 12/2003 | Kim |
| 6,758,801 | B2 | 7/2004 | Harding et al. |
| 6,918,489 | B2 | 7/2005 | Harding et al. |
| 7,022,060 | B2 | 4/2006 | Toth |
| 7,172,548 | B2 | 2/2007 | Toth |
| 7,441,765 | B2 | 10/2008 | Okamoto |
| 7,464,924 | B2 | 12/2008 | Morimoto et al. |
| 7,490,789 | B2 | 2/2009 | Omi |
| 7,500,664 | B2 | 3/2009 | Nakashima |
| 2005/0082742 | A1 | 4/2005 | Kang et al. |
| 2007/0273079 | A1 | 11/2007 | Omi et al. |
| 2008/0153685 | A1 | 6/2008 | Cheich et al. |
| 2009/0008871 | A1 | 1/2009 | Omi |
| 2009/0075800 | A1 | 3/2009 | Wetsch et al. |

* cited by examiner

MACHINE FOR PRODUCING PACKAGING CUSHIONING

BACKGROUND OF THE INVENTION

The present invention relates generally to packaging materials and, more specifically, to a machine and method for producing packaging cushioning from sheets of a selected substrate, such as paper.

Machines for producing packaging cushioning from paper are well-known in the art. Such machines generally operate by pulling a web of paper from a roll, manipulating the paper web in such a way as to convert the paper into packaging cushioning, and then severing the cushioning into cut sections of a desired length.

While such machines are widely used and have been commercially successful, in many applications, there is a need for improved functionality. For example, paper rolls tend to be quite heavy and cumbersome to lift and load onto cushion conversion machines. Although the volume of cushioning that can be produced from a roll of paper tends to off-set the weight disadvantage for high-volume packaging operations, for lower-volume packaging operations, a lighter, easier-to-handle alternative would be preferred.

Moreover, while severing mechanisms in roll-fed machines provide a workable means for producing cushions of a desired length, such mechanisms present ongoing safety concerns, in both the design and operation of such machines.

As a result, Sealed Air Corporation (US), assignee of the present invention, has developed a machine that produces packaging cushions of a desired length without the need for a severing or perforation mechanism, by joining individual sheets of paper together in such a way that packaging cushions having any desired length can be produced. Such machine, which is described in U.S. patent application Ser. No. 12/583,749, also allows the density of the resultant packaging cushions to be varied as desired to suit the weight or nature of the objects being packaged. This is accomplished by overlapping the sheets to a desired extent, in order to achieve a desired density in the resultant packaging cushions.

One area for improvement that has been identified with the '749 machine concerns the tracking and handling of the paper sheets, particularly when making higher-density packaging cushions. In general, the density of the packaging cushions is proportional to the degree of overlap between successive sheets. Thus, the greater the degree of overlap between adjacent sheets, the higher will be the density of the resultant cushion. It has been found, however, that above a certain point of overlap, the increased resistance to forward movement of the paper sheets results in poor tracking, rippling, and then jamming of the sheets, resulting in the necessity of shutting down the machine to clear the jams, which causes paper to be wasted and production time to be lost.

Accordingly, there is a need in the art for an improvement to sheet-fed packaging-cushion machines, which will reduce or prevent paper jams while still allowing higher-density packaging cushions to be produced.

SUMMARY OF THE INVENTION

That need is met by the present invention, which, in one aspect, provides a machine for producing packaging cushioning, comprising:

a. a first feed mechanism for successively feeding sheets of a substrate at a first speed, the first feed mechanism including a motor and a power supply therefor, wherein the motor is capable of drawing a varying amount of electricity from the power supply when the first feed mechanism feeds the sheets;

b. a second feed mechanism for receiving the sheets from the first feed mechanism and feeding the sheets at a second speed;

c. a control unit for controlling at least one of the first and second speeds to produce a desired degree of overlap between successive sheets; and d. a sensor to measure the amount of electricity drawn by the motor, the sensor being structured and arranged to generate a signal, which is indicative of the amount of electricity drawn by the motor, and communicate the signal to the control unit, wherein, the control unit is structured and arranged to modulate the amount of electricity that the motor draws from the power supply when the signal from the sensor has a value that is greater than or equal to a predetermined value.

Advantageously, by measuring the amount of electricity drawn by the motor, comparing this to a predetermined value, which is indicative of the onset of the a paper jam, and then modulating the amount of electricity that the motor can draw, a desired degree of overlap, leading to a desired packaging-cushion density, can still be achieved, but with a reduced likelihood of sheet misalignment and jamming.

These and other aspects and features of the invention may be better understood with reference to the following description and accompanying drawings.

DETAILED DESCRIPTION OF THE INVENTION

Figure 1:
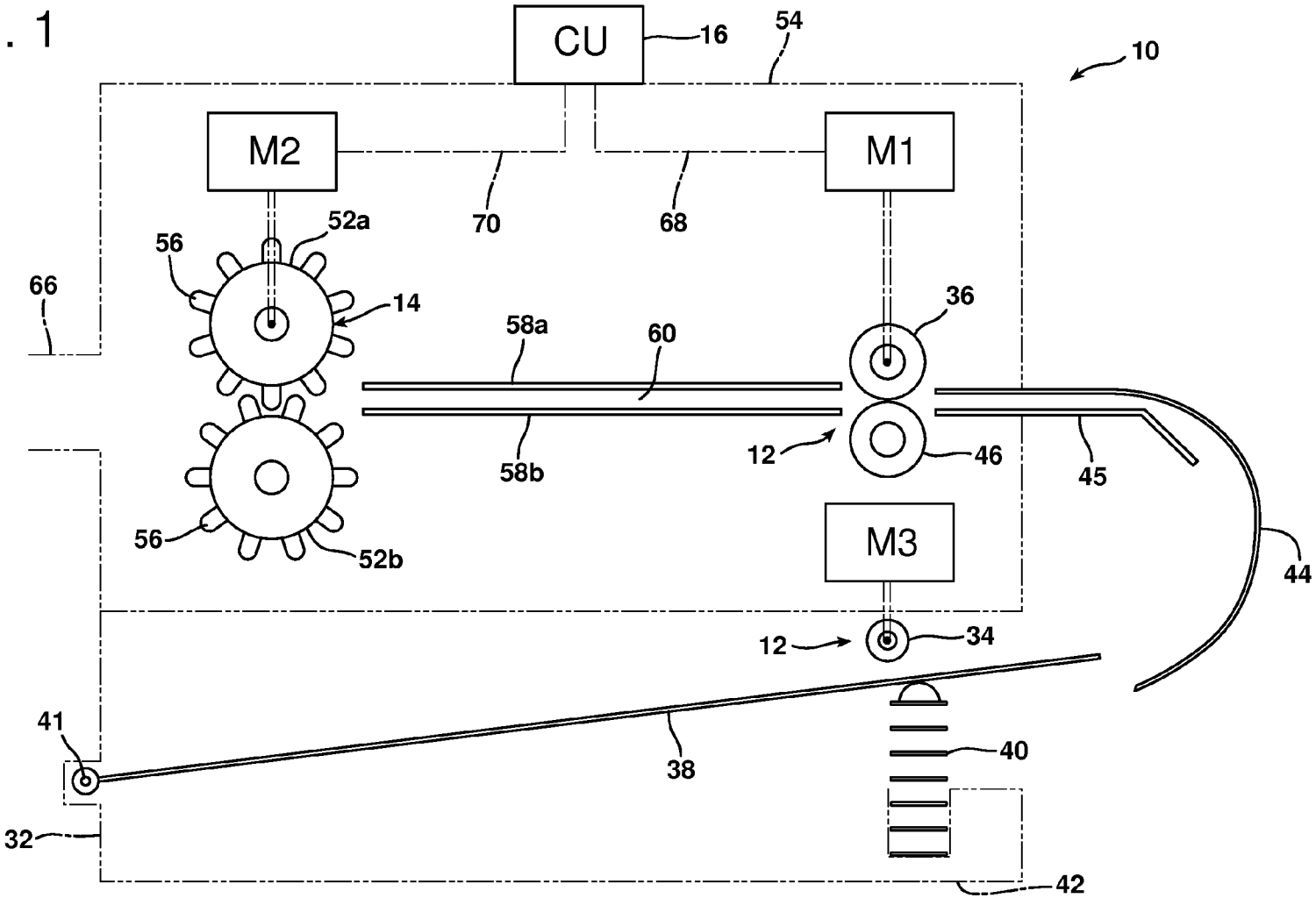
FIG. 1 is a schematic view of a machine for producing packaging cushioning in accordance with the present invention.

FIG. 1 schematically illustrates a machine 10 in accordance with the present invention for producing packaging cushioning. Machine 10 comprises a first feed mechanism 12, a second feed mechanism 14, and a control unit 16.

Figure 2:
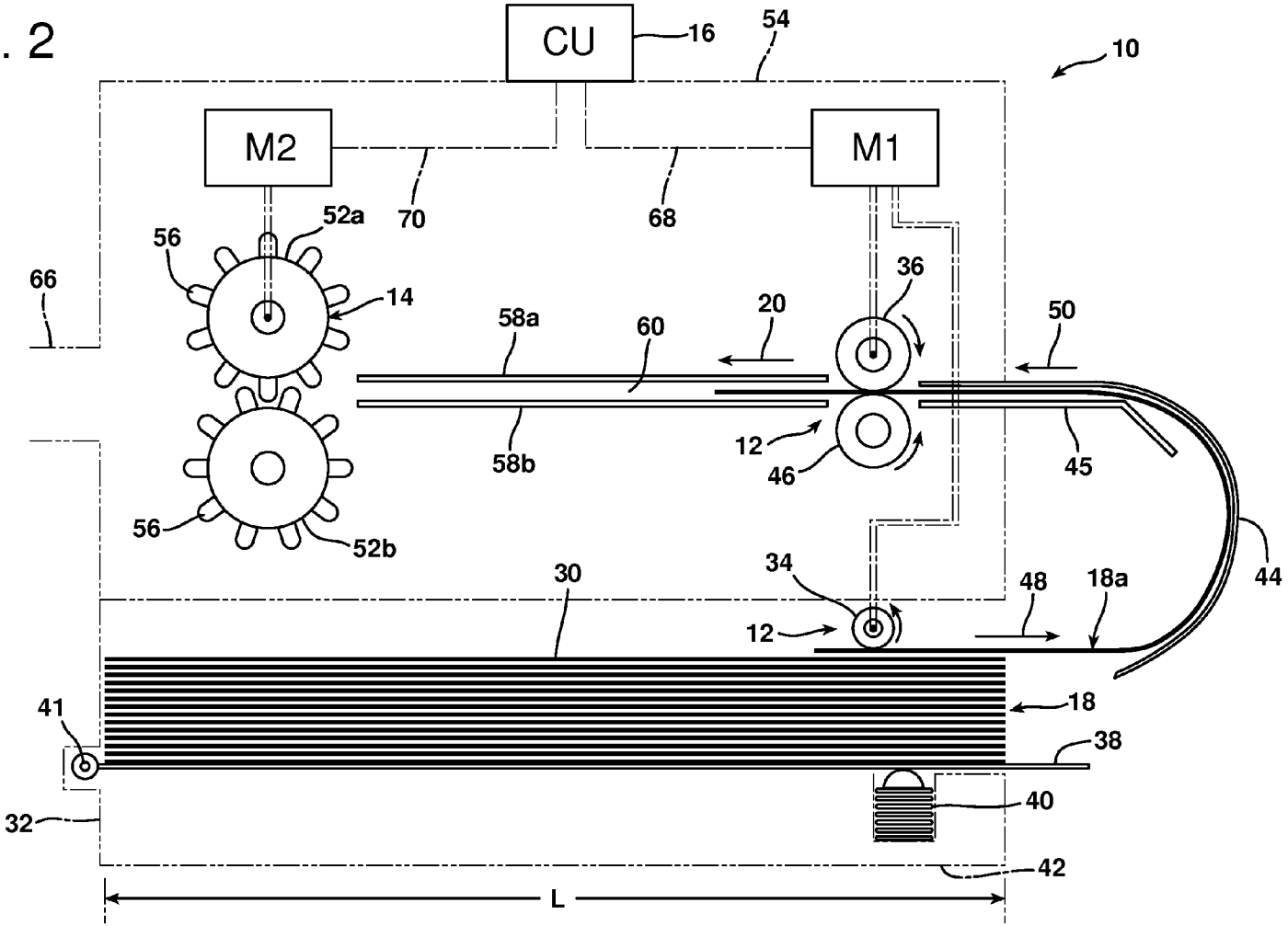
FIGS. 2-6 are similar to FIG. 1, and show the machine in various stages of packaging cushion production.

As shown in FIGS. 2-6, first feed mechanism 12 successively feeds sheets 18 of a substrate at a first speed, which is represented by arrow 20 (FIG. 2).

Figure 3:
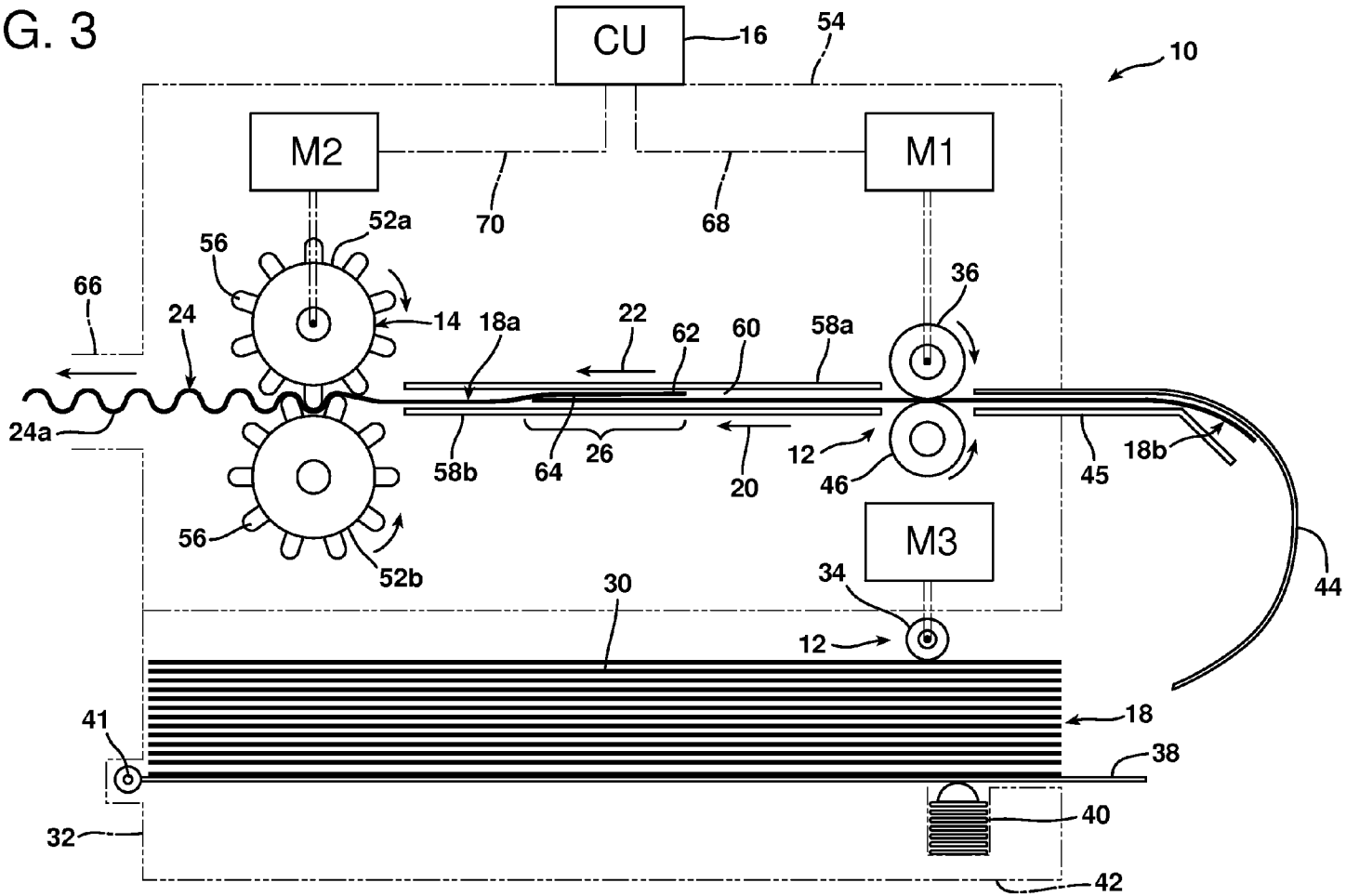

Second feed mechanism 14 receives the sheets 18 from the first feed mechanism 12, and conveys the sheets at a second speed, which is represented by arrow 22 (FIG. 3). The conveyance of the sheets 18 by second feed mechanism 14 may be effected in such a manner that the sheets are converted into packaging cushion units 24, e.g., by compressing and/or crumpling the sheets as shown. Thus, in some embodiments, the second feed mechanism 14 may function as a 'crumpling mechanism.'

Figure 4:
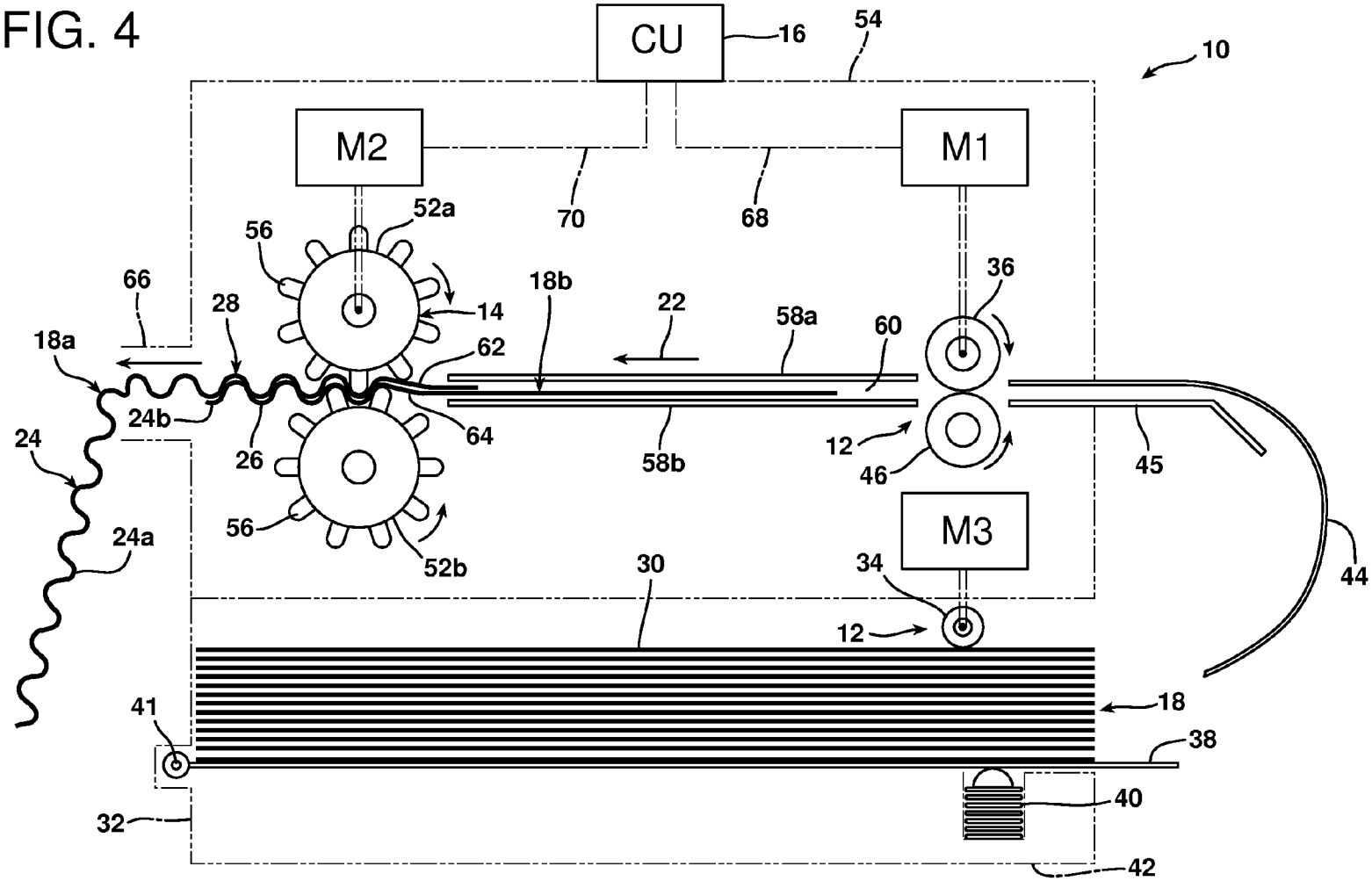
Figure 5:
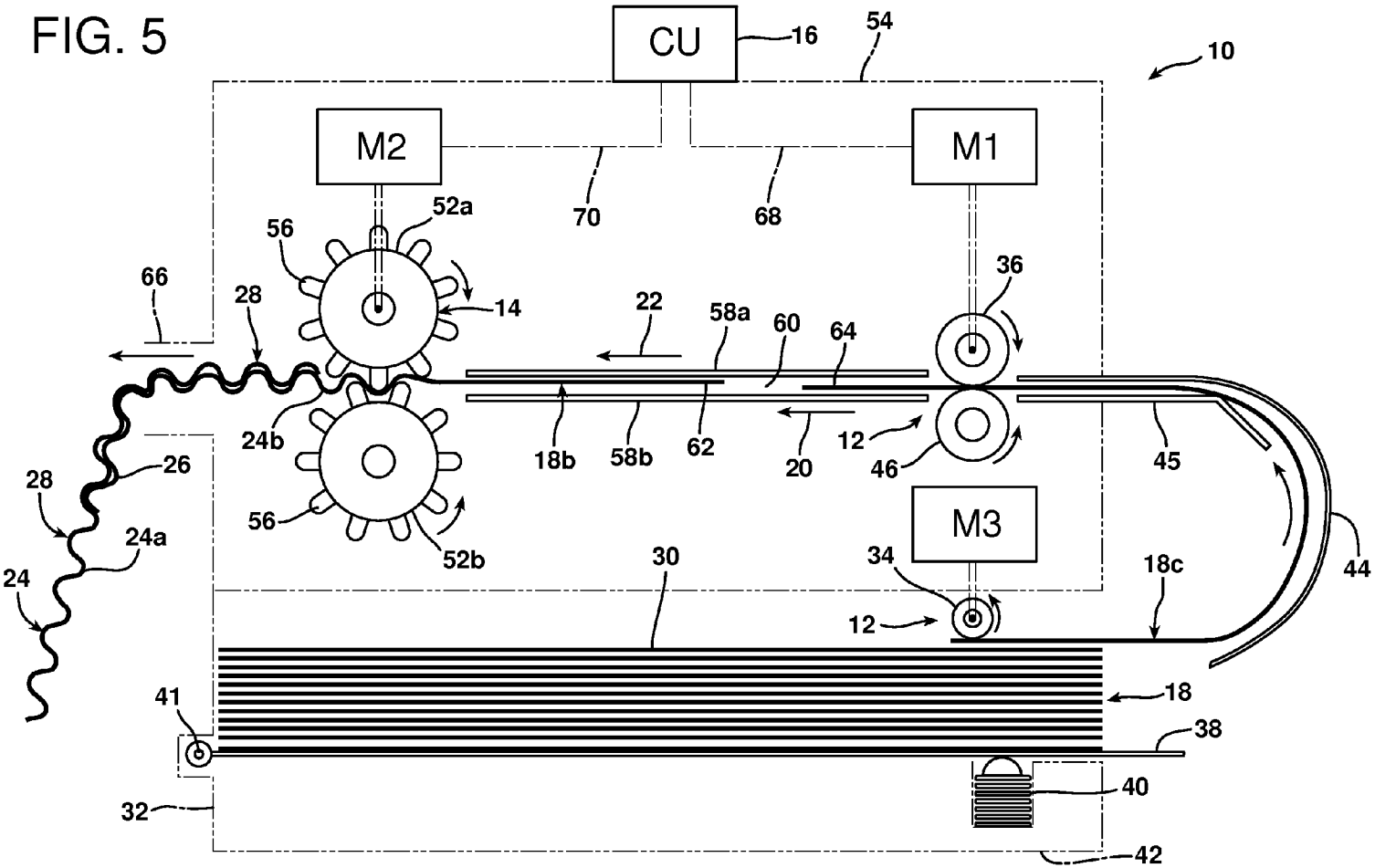
Figure 6:
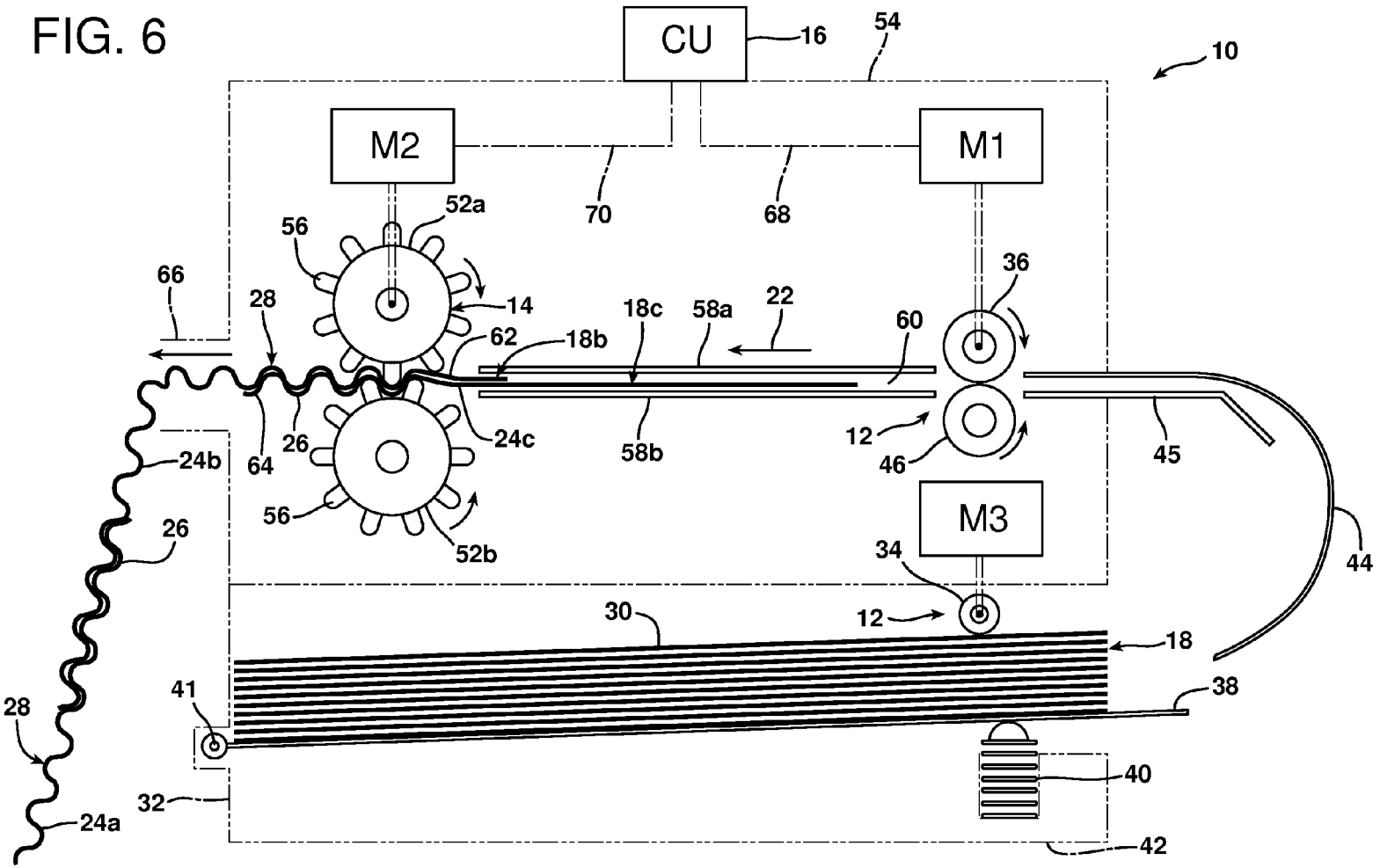

Control unit 16 controls at least one of the first and second speeds 20, 22 to produce a desired degree of overlap 26 between successive sheets 18 (FIG. 3). Such overlap 26, e.g., in combination with the compression and/or crumpling of the sheets in second feed mechanism 14, may be employed to generate a connected series 28 of packaging cushion units 24 (FIGS. 4-6). The connected series 28 of packaging cushion units 24 may be structured to have a density that is proportional to the degree of overlap 26 between successive sheets 18.

Sheets 18 may comprise any type of material desired for use in packaging cushions, including paper, e.g., kraft paper, fiberboard, thermoplastic film, etc., including recycled forms of the foregoing materials, as well as combinations thereof, e.g., laminated paper, coated paper, composite paper, etc. The sheets may have any desired shape, e.g., square, rectangular, etc., with any desired dimensions, e.g., a 20 inch length dimension and a 15 inch width dimension.

Sheets 18 may be arranged for supply to machine 10 in any convenient form, e.g., as a stack 30 as shown, or in shingled, random, or individual form, etc., as desired. When sheets 18 are arranged as a stacked supply 30 as shown, machine 10 may further include a supply tray 32, which is configured and dimensioned for holding the sheets in a stacked arrangement of desired height, i.e., to accommodate a desired maximum number of sheets 18 in stack 30. When such an embodiment is employed, first feed mechanism 12 may be disposed and configured for feeding the sheets 18 from supply tray 32 to second feed mechanism 14. As such, the first feed mechanism 12 may comprise a first feed roller 34 to advance the sheets 18 from the supply 30 thereof, and a second feed roller 36 to receive the sheets from the first feed roller 34 and feed the sheets into second feed mechanism 14.

The first feed roller 34 may be associated with a motor, schematically designated as motor "M3" in the drawings, to drive the rotation of the feed roller. The feed roller 34 may be in a fixed position relative to tray 32, with the tray including a movable tray base 38, e.g., pivotally movable as shown, which may be biased towards feed roller 34, e.g., via spring 40. In this manner, as the stacked supply 30 of sheets 18 depletes, the sheets are continuously urged against the feed roller 34 so that the feed roller can continue to advance the sheets sequentially from the stack.

FIGS. 2-6 illustrate tray 32 with a relatively full stack 30, such that spring 40 is fully compressed and tray base 38 is substantially aligned with the bottom 42 of tray 32. The pivot point for tray base 38, e.g., hinge 41 as shown, may be placed at any desired location along the bottom 42 of tray 32, e.g., opposite from spring 40 as shown or, e.g., closer to spring 40 such that the movable tray base 38 is shorter than as shown.

Instead of, or in addition to, a movable tray base 38, the first feed roller 34 may be movably biased towards the stack 30.

Figure 8:
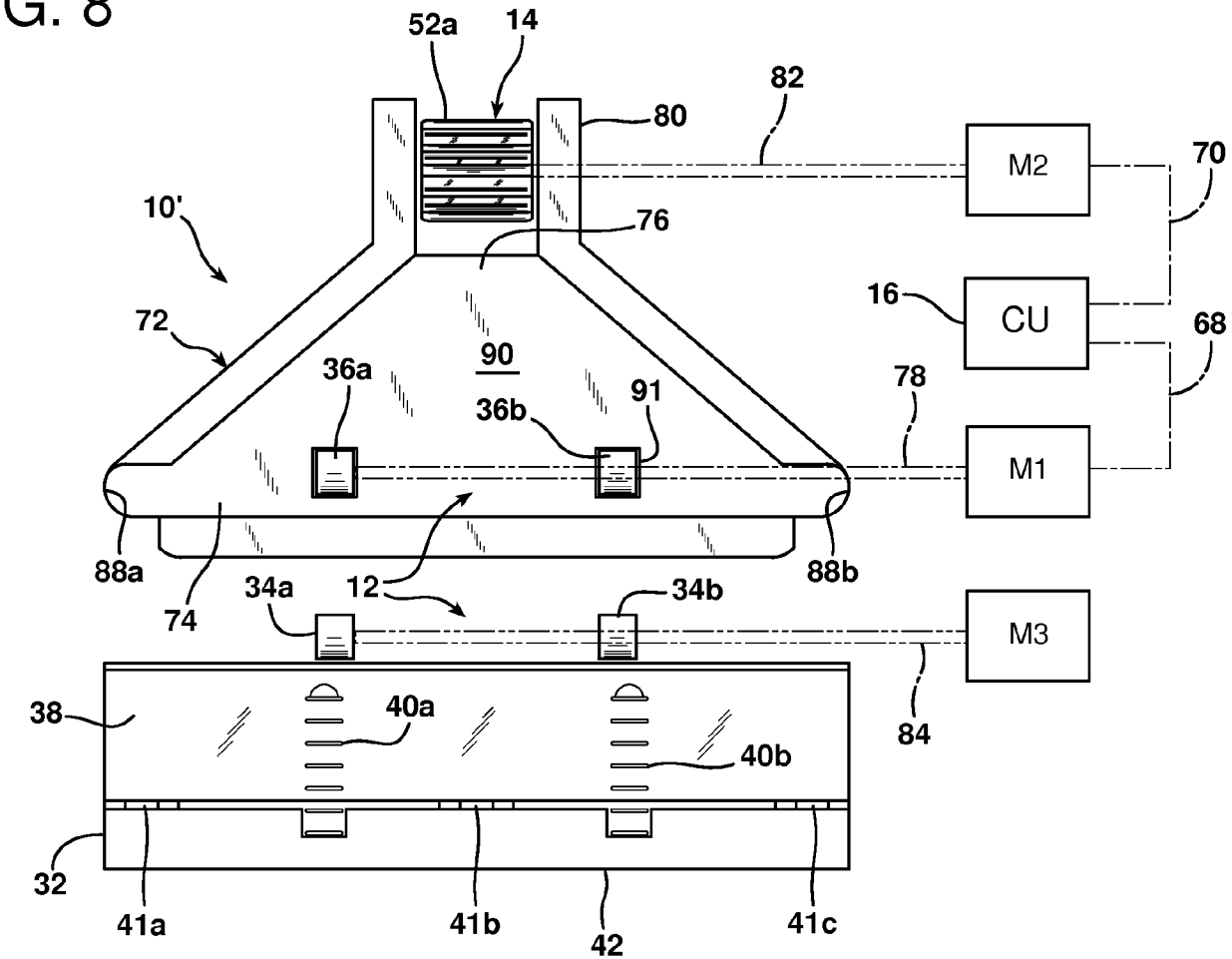
FIG. 8 is a perspective view of the machine shown in FIG. 7, along lines 8-8.

First feed roller 34 may be accompanied by as many additional feed rollers as necessary to advance the sheets 18. For example, two or more feed rollers 34 may be arrayed across the width of the sheets 18, e.g., as shown in FIG. 8 (wherein first feed roller 34 is shown as a pair 34*a, b* of such feed rollers).

As shown in the illustrated embodiment, the second feed roller 36 is positioned to receive the sheets 18 from first feed roller 34, e.g., via guide member 44, and then feed the sheets into the second feed mechanism 14. The second feed roller 36 may be associated with a motor, schematically designated as motor "M1" in the drawings, to drive the rotation of the feed roller. As an alternative to the illustrated embodiment in which separate motors M3 and M1 are employed to drive the rotation of the first and second feed rollers 34 and 36, respectively, a single motor may be employed to drive the rotation of both the first and second feed rollers 34 and 36, e.g., via appropriate linkage, which may include drive belt(s), drive chain(s), drive axel(s), etc. Such an alternative embodiment is illustrated schematically in FIG. 2, wherein motor M1 drives the rotation of both the first and second feed rollers 34, 36.

Second feed roller 36 may be accompanied by as many additional feed rollers as necessary to advance the sheets 18. For example, two or more feed rollers 36 may be arrayed across the width of the sheets 18, e.g., as shown in FIG. 8 (wherein second feed roller 36 is shown as a pair 36*a, b* of feed rollers).

A backing member 46 may be included, to provide a support against which second feed roller 36 rotates, to thereby facilitate the feeding of sheets 18 into second feed mechanism 14. Backing member 46 may be a static member, which provides frictional resistance to the rotation of roller 36 such that the sheets 18 are compressed between the roller 36 and backing member 46 while passing therebetween, with the sheets making sliding contact with the member 46. Alternatively, backing member 46 may be a rotational member, which rotates passively via rotational contact with the driven roller 36. As a further alternative, the relative position of the second feed roller 36 and backing member 46 may be switched such that the driven roller 36 is beneath the backing member 46. This orientation may be particularly convenient when a single motor is employed to power the rotation of both the first and second feed rollers.

As may be appreciated, first feed mechanism 12 generally defines a path of travel along which the sheets 18 move between the supply 30 of the sheets and the second feed mechanism 14. As mentioned briefly above, the first feed mechanism 12 may further include guide member 44, which may be included to facilitate the movement of the sheets along the travel path, e.g., by directing the movement of the sheets from the first feed roller 34 to the second feed roller 36.

The guide member 44 may be structured and arranged to change the movement of the sheets 18 on the travel path, e.g., from a first direction 48, in which the sheets are fed from supply/stack 30, to a second direction 50, in which the sheets are crumpled (FIG. 2). Advantageously, this allows the machine 10 to have a compact configuration or 'footprint,' e.g., in which the supply tray 32 with sheet supply 30 is positioned beneath second feed mechanism 14 as shown.

In the presently illustrated embodiment, the second feed mechanism 14, second feed roller 36, backing member 46, and motors M1, M2 may be contained within a housing 54 (shown in phantom). The first direction 48 may be substantially parallel to and substantially opposite from the second direction 50 (see, FIG. 2), such that the housing 54 may be positioned substantially directly above the supply tray 32, e.g., in a stacked configuration as shown. Guide member 44 may thus define an arcuate path of travel for sheets 18 as shown, e.g., with approximately 180 degrees of curvature. With such a structure, secondary or inner guide member 45 may also be included, and may have a complementary position on the inside of the arcuate path defined by guide member 44 as shown.

In the above-described embodiment, the second feed roller 36 receives the sheets 18 indirectly from the first feed roller 34, e.g., via guide member 44. Alternatively, the first feed mechanism 12 may define a more linear path of travel for the sheets 18, in which the sheets are advanced from supply 30 in substantially the same direction as they are crumpled in second feed mechanism 14. This may be accomplished, e.g., by positioning the supply tray 32 beside, rather than beneath, housing 54. In such embodiment, the second feed rollers may receive the sheets 18 substantially directly from the first feed roller 34, i.e., with no intervening guide member 44. More generally, supply tray 32 and housing 54 may have any desired relative orientation. For example, the tray 32 and housing 54 may be positioned at 90 degrees to one another, e.g., with the housing 54 having a substantially horizontal orientation and the tray 32 having a substantially vertical orientation.

Feed rollers 34, 36 may comprise any material suitable for conveying sheets 18, such as metal (e.g., aluminum, steel, etc.), rubber, elastomer (e.g., RTV silicone), urethane, etc., including combinations of the foregoing materials. As an alternative to wheel-type rollers as shown, one or both feed rollers 34, 36 may comprise one or more counter-rotating drive belts, drive bands, etc. As a further alternative to feed rollers 34, 36, or in addition thereto, first feed mechanism 12 may convey the sheets 18 via any suitable sheet-handling means, including pneumatic conveyance, electrostatic conveyance, vacuum conveyance, etc.

Second feed mechanism 14 may comprise a pair of compression members 52*a* and 52*b* that convert the sheets 18 into packaging cushion units 24 by compressing and/or crumpling the sheets therebetween. The compression members 52*a, b* may comprise a pair of counter-rotating wheels, belts, etc., or, as shown, a pair of counter-rotating gears, which may have radially-extending teeth 56 that mesh together to effect the crumpling of the sheets 18, e.g., as illustrated in FIGS. 3-6. The teeth 56 are preferably sized and shaped to convey and crumple the sheets 18 without tearing the sheets. The compression members 52*a, b* and teeth 56 may be formed of any material capable of conveying and crumpling the sheets 18, and preferably with sufficient toughness to withstand wear but without causing damage to the sheets 18. Many suitable materials exist. Examples include polymeric materials such as ultra-high molecular weight polyethylene (UHMWPE), polyimide, fluorocarbon resins such as polytetrafluoroethylene (PTFE) and perfluoropropylene, acetal resins, i.e., resins based on polyoxymethylene, including homopolymers (e.g., Delrin® brand polyoxymethylene), copolymers, and filled/impregnated grades, such as PTFE-filled acetal resins; various metals such as aluminum, steel, etc.; metals with low-COF coatings, e.g., anodized aluminum or nickel impregnated with low-COF polymers such as PTFE or other fluorocarbon resins; and mixtures or combinations of the foregoing.

The compression members 52*a, b* may connect the packaging cushion units 24 together by compressing and/or crumpling the sheets 18 at the overlap 26 between successive sheets. That is, the action of compressing/crumpling two overlapped sheets together has the effect of joining the sheets together at the overlapped portions of the sheets. By controlling the first speed 20 relative to the second speed 22, the overlap 26 can have any desired degree. Preferably, the overlap 26 is only a partial overlap such that a chain of the sheets 18, as converted into packaging cushion units 24, may be connected together, i.e., to form connected series 28.

FIGS. 2-6 illustrate a sequence of events that lead to the conversion of sheets 18 into packaging cushion units 24, and to their being connected together to form a connected series 28 of the packaging cushion units 24.

FIG. 2 illustrates the beginning of the production process, in which first feed roller 34 of first feed mechanism 12 engages the upper-most sheet 18*a* in stack 30, and rotates in the direction of the indicated arrow to move the sheet in first direction 48. Sheet 18*a* immediately encounters guide member 44, which causes it to change course to second direction 50, thereby leading the sheet 18*a* into the nip between second feed roller 36 and backing member 46. Motor M1 is powering the rotation of the second feed roller 36, as indicated by the rotational arrows associated with the feed roller 36 and backing member 46, such that sheet 18*a* is fed towards second feed mechanism 14 at first speed 20. The magnitude of first speed 20 is determined by the output of motor M1. If a separate motor M3 is employed (FIG. 3), motors M1 and M3 may be synchronized such that the speed at which the sheets 18 are advanced from supply 30 is the same as the speed 20 at which the sheets are fed to the second feed mechanism 14. Alternatively, by operating the first and second feed rollers 34, 36 at different speeds, compressive or tensional forces may be imparted on the sheets 18 prior to their conveyance to the second feed mechanism 14. As a further alternative, as shown in FIG. 2, only one motor M1 may be employed in place of the separate motors M1 and M3, with the rotational output of motor M1 being transmitted to both the first and second feed rollers 34, 36.

The feeding of the sheets 18 by the first feed mechanism 12 may be facilitated by including a second guide member, which may include upper and lower guide plates 58*a, b*. As shown, guide plates 58*a, b* may be positioned between second feed roller 36 and second feed mechanism 14, and arranged to form a passage 60 therebetween to guide the movement of the sheets 18 as they are fed by the second feed roller 36 and into the second feed mechanism 14.

In FIG. 3, a second sheet 18*b* has been withdrawn from supply stack 30 by first feed roller 34, transferred to second feed roller 36, and is being fed through passage 60 towards second feed mechanism 14 by the second feed roller 36 at first speed 20. At the same time, the first sheet 18*a* has reached second feed mechanism 14 and is being crumpled and conveyed thereby at second speed 22. Second speed 22 results from the rotational speed at which the compression members 52*a, b* counter-rotate against one another, as indicated by the rotational arrows. The rotational speed of the compression members 52*a, b*, in turn, is determined by the output of motor M2.

As noted above, at least one of the first and second speeds 20, 22 may be controlled to produce a desired degree of overlap 26 between successive sheets 18, thereby generating the connected series 28 of packaging cushion units 24. As shown in FIG. 3, the overlap 26 is produced between the trailing end 62 of sheet 18*a* and the leading end 64 of sheet 18*b*. Such overlap may result from a speed differential between first speed 20 and second speed 22.

For example, the second feed mechanism 14 and second feed roller 36 may be operated such that second speed 22 is slower than first speed 20. In this manner, when sheet 18*a* is released from first feed mechanism 12 and engaged only by second feed mechanism 14, it will be moving at the slower second speed 22. Conversely, while the next sheet 18*b* is engaged only by the first feed mechanism 12, i.e., prior to the leading end 64 thereof reaching the second feed mechanism 14, it (sheet 18*b*) moves at the relatively higher first speed 20. As a result, the leading end 64 of sheet 18*b* overtakes and slides over or under the trailing end 62 of sheet 18*a*, to form overlap 26 as shown. The degree of the overlap 26 will continue to increase until the leading end 64 of sheet 18*b* reaches the second feed mechanism 14 and/or sheet 18*b* is released from first feed mechanism 12.

That is, as shown in FIG. 4, once the leading end 64 of sheet 18*b* becomes engaged by the second feed mechanism 14, the speed at which the sheet 18*b* moves through machine 10 will decrease from first speed 20 to second speed 22. At that point, with both sheets 18*a, b* moving at the same speed, i.e., speed 22, and both sheets being engaged by second feed mechanism 14, no further relative movement of sheets 18*a, b* will occur, such that no further increase in the overlap 26 will occur. Thus, as shown, the overlapped section 26 of successive sheets 18*a* and 18*b* are crumpled or compressed together in second feed mechanism 14, which has the effect of joining the trailing end 62 of sheet 18*a* to the leading end 64 of the following sheet 18*b*. This, in turn, results in the connection of the packaging cushion unit 24*a*, as formed by the crumpled sheet 18*a*, to the next packaging cushion unit 24*b*, which is being formed in FIG. 4 from sheet 18*b* as it is crumpled or otherwise compressed in second feed mechanism 14.

In FIG. 5, the connection process between packaging cushion units 24*a* and 24*b* is complete in that the overlap 26 between the respective successive sheets 18*a* and 18*b* has moved through and past second feed mechanism 14. The remainder of sheet 18*b* is being crumpled to complete its conversion into packaging cushion unit 24*b*. The resultant series 28 of connected packaging cushion units is being conveyed out of machine 10, e.g., via outlet 66 in housing 54. If desired, a receptacle, e.g., a storage bin or the like (not shown), may be employed for containment of the connected series 28 of packaging cushion units 24 until such cushion units are needed for use. In such case, the outlet 66 may be configured to guide the connected series 28 directly into the receptacle.

Also in FIG. 5, first feed roller 34 of first feed mechanism 12 engages the next sheet 18*c* in stack 30, and advances it towards second feed roller 36 via guide member 44. The sheet 18*c* then moves through the nip between second feed roller 36 and backing member 46 at first speed 20 towards the preceding sheet 18*b*, which is moving at a slower second speed 22 as a result of its engagement by second feed mechanism 14. The speed differential between speeds 20 and 22 will result in leading end 64 of sheet 18*c* overtaking the trailing end 62 of the preceding sheet 18*b* to form another overlap 26 (shown in FIG. 6), as described above relative to FIG. 3.

In FIG. 6, an overlap 26 has formed between the leading end 64 of sheet 18*c* and the trailing end 62 of the preceding sheet 18*b*. Such overlap 26 is being crumpled together in second feed mechanism 14, which has the effect of joining the trailing end 62 of sheet 18*b* to the leading end 64 of the following sheet 18*c*. This, in turn, results in the connection of the packaging cushion unit 24*b*, as formed by the crumpled sheet 18*b*, to the next packaging cushion unit 24*c*, which is being formed from sheet 18*c* as it is crumpled in second feed mechanism 14.

As also shown in FIG. 6, as the supply 30 of sheets 18 in tray 32 depletes, spring 40 extends, and thereby causes the tray base 38 to pivot upwards to maintain the uppermost sheet in the supply stack in contact with first feed roller 34.

The foregoing process may continue for as long as desired, e.g., until supply 30 of sheets 18 in tray 32 is depleted, in order to add as many additional packaging cushion units 24 as desired to the connected series 28.

Figure 13:
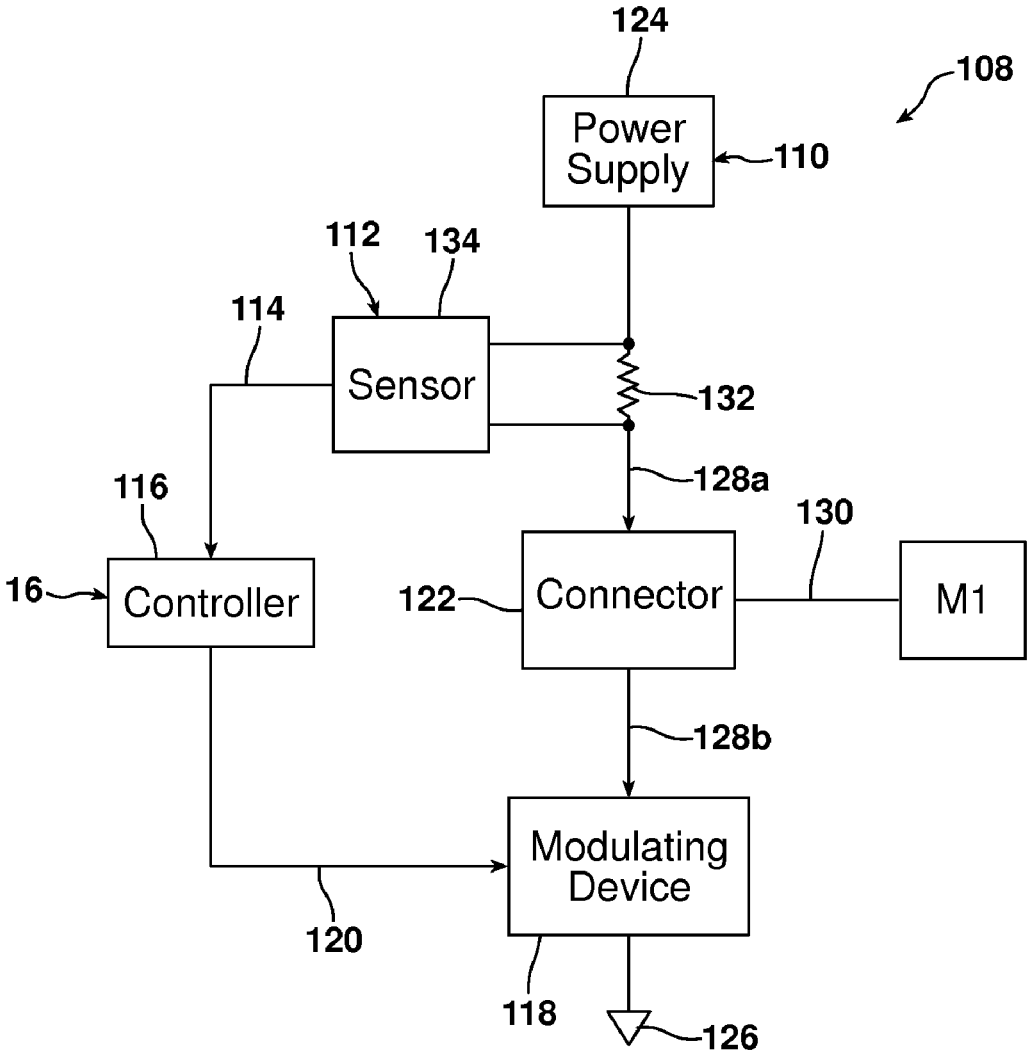
FIG. 13 is a schematic block diagram, which illustrates a control system for reducing or eliminating paper jams in the machines illustrated in FIGS. 1-12.

First speed 20 and/or second speed 22 may be controlled by controlling the rotational speed of the second feed roller 36 and/or that of the compression member 52*a* and/or b, respectively. Control unit 16 may thus be in electrical communication with motor M1 and/or M2. Thus, for example, the speed at which motor M2 drives the rotation of the compression members 52*a, b* may be fixed, while control unit 16 may be operably linked to motor M1 to cause the motor to provide a range of controllable output speeds which, in turn, produce a range of rotational speeds for second feed roller 36. Alternatively, the speed of motor M1 may be fixed while motor M2 is a variable speed motor, the speed of which is controlled by control unit 16. This alternative may be selected when control system 108 is included, as described below (FIG. 13). As a further alternative, both motors M1 and M2 may be variable-speed motors, and both may be operably linked to control unit 16, e.g., via respective control/power-supply wires 68 and 70 as shown, so that the speed of one or both of motors M1, M2 may be controlled.

Control unit 16 may be in the form of a printed circuit assembly, and include a controller, e.g., an electronic controller, such as a microcontroller, which stores pre-programmed operating codes; a programmable logic controller (PLC); a programmable automation controller (PAC); a personal computer (PC); or other such control device which allows the speed of motors M1 and/or M2 to be controlled. Commands may be supplied to the control unit 16 via an operator interface or the like, or may be supplied remotely or substantially completely via pre-programming, i.e., full automation.

Control unit 16 may control the operation of motor M1 and/or M2, thereby controlling at least one of the first and second speeds 20, 22, automatically, manually, or via a combination of both automatic and manual control. In some embodiments, control unit 16 may be configured to receive input from an operator, i.e., from an operator interface such as a foot pedal, hand switch, control panel, etc., including combinations of the foregoing. An operator may thus be able to select a desired degree of overlap between successive sheets, as well as the number of packaging cushion units to be connected in a given series of such units.

Thus, for example, control unit 16 may include, or be electronically associated with, an operator input device, e.g., a switch or the like (not shown), which allows the operator to select a desired degree of overlap between successive sheets. A two-position switch, for example, could allow an operator to choose between a 'low-density' mode of operation and a 'high-density' mode of operation.

Figure 7:
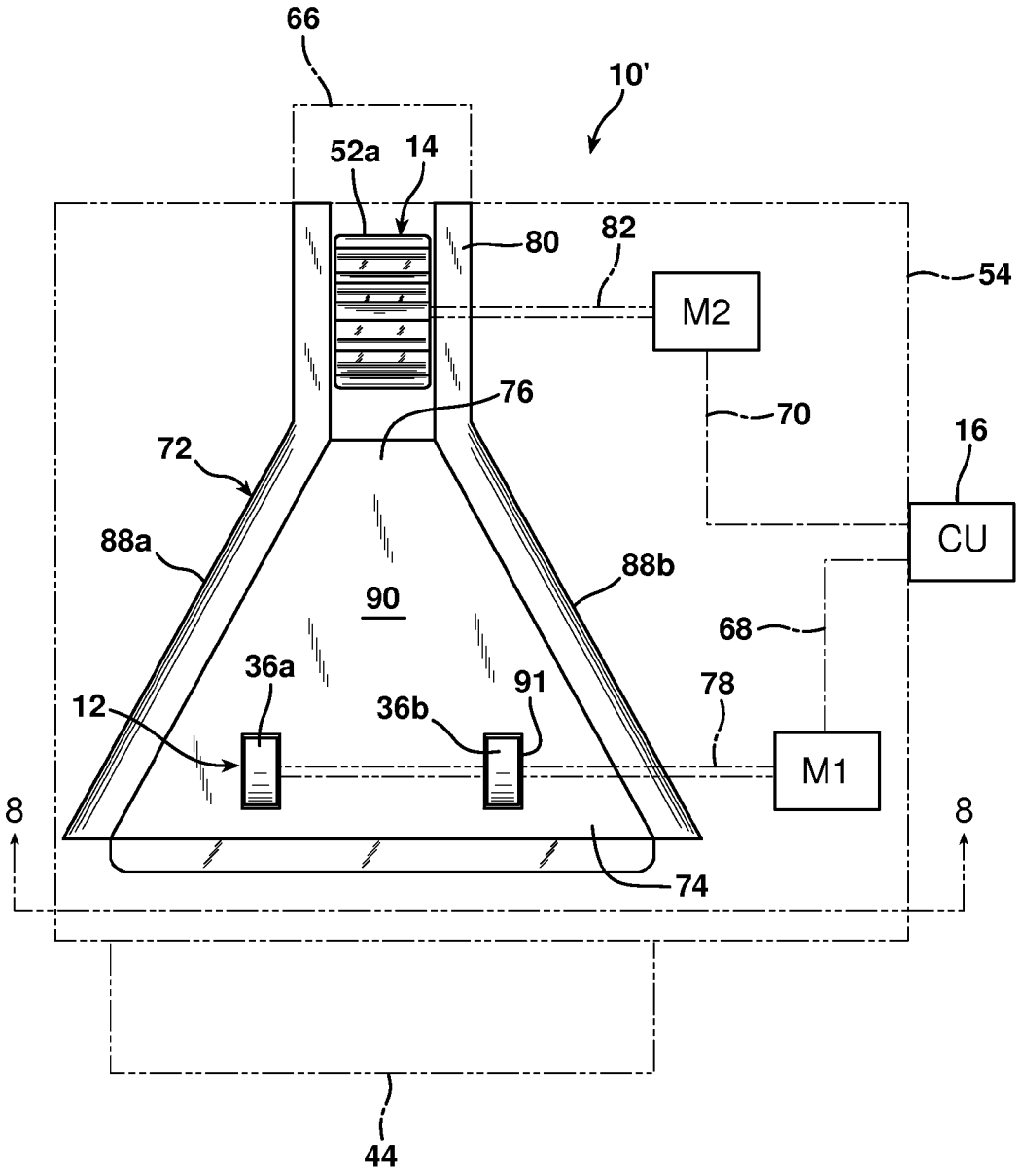
FIG. 7 is a plan view of an alternative machine in accordance with the present invention.

In the 'low-density' mode, control unit 16 would command machine 10 to connect packaging cushion units 24 together with a minimum degree of overlap, e.g., just enough to form a connection, such as between about 1 and about 3 inches of overlap between successive sheets. The advantage of the low-density mode is that a minimal amount of sheets 18 are used for a given length of connected packaging cushion units 24, thus providing an economical mode of operation as would be appropriate, e.g., for the packaging of lighter-weight objects. As an example, for sheets 18 having a length of 20 inches and a width of 17 inches, such low-density/minimal overlap mode was achieved when machine 10 was configured as alternative machine 10' as shown in FIGS. 7-9, and was operated at a first speed 20 of about 40 inches/second and a second speed 22 of about 26 inches/second, or a first speed 20/second speed 22 ratio of about 1.5. Such speed ratio of about 1.5 resulted in an overlap 26 of about 2 inches.

In the 'high-density' mode, control unit 16 would command machine 10 to connect packaging cushion units 24 together with a greater degree of overlap, e.g., between about 4 and about 6 inches of overlap between successive sheets. Although a greater number of sheets 18 are used to produce a given length of connected packaging cushion units 24, i.e., as compared with the low-density mode, an increase in the density of the packaging cushions often becomes necessary when the packaging application changes, e.g., to properly protect higher-weight objects in a package. As an example, for sheets 18 having a length of 20 inches and a width of 17 inches, such high-density/higher overlap mode was achieved when machine 10 was configured as alternative machine 10' as shown in FIGS. 7-9, and was operated at a first speed 20 of about 28 inches/second and a second speed 22 of about 12 inches/second, resulting in a speed differential of about 16 inches/minute. Such speed differential of 16 inches/minute resulted in an overlap 26 of about 5 inches. Stated differently, the speed ratio between first speed 20 (28 inches/second) and second speed 22 (12 inches/minute) in this example was about 2.33.

An alternative control scheme is to enable the operator to select any desired differential or ratio between first speed 20 and second speed 22, between pre-set minimum and maximum amounts. For example, a potentiometer that adjusts the speed ratio between first speed 20 and second speed 22 may be employed, wherein a setting of "0" (zero) corresponds to the minimum allowed differential between speeds 20 and 22 (minimum allowed overlap between successive sheets/minimum density), and "10" (ten) corresponds to the maximum allowed differential between such speeds (maximum allowed overlap/maximum density). Another alternative would be to have a multitude of preset density conditions, which the operator can select by switching between predetermined ratio settings using a multi-position switch.

As a further alternative, control unit 16 may be configured to allow an operator to set the operating speeds of motor M1 and/or M2 manually, e.g., as the sole means of control. In such embodiment, control unit 16 may be a simple device containing, for example, a multi-position switch or dial to control the speed of motor M1/second feed roller 36 and/or a second switch or dial to control the speed of motor M2/compression members 52*a, b*.

As may be appreciated, the ability to easily change the density of the connected series 28 of packaging cushion units 24 as needed, i.e., without having to change to a different type/weight of sheet, or add sheets from a different source, in order to suit the changing needs of differing packaging applications is a highly advantageous feature of the present invention.

The control unit 16 may further include or be associated with a dial or the like, which allows an operator to select a desired number of packaging cushion units to be produced upon a further command from the operator, such as the actuation of a foot pedal or hand switch (not shown) in electrical communication with the control unit. Such actuation by the operator will then result in machine 10 commencing operation and continuing to operate until the selected number of packaging cushion units are produced.

In one mode of operation, control unit 16 may be programmed by specifying, via appropriate input command, the diameter of both the first and second feed rollers 34, 36, as well as the length of the sheets 18. When control unit 16 is operably linked to motor M1 as described above (i.e., via control/power-supply wire 68), and optionally also to motor M3 (control wire not shown; M1 and M3 may be the same motor) the speed of motors M1 and M3 may be controlled by control unit 16. Based on the operational run-time and rotational-speed commands that the control unit has given to each of the feed rollers 34, 36, coupled with any necessary feedback to verify that such commands have been carried out, the control unit 16 will "know", through simple calculations, the approximate number of sheets 18 that have been fed by the first feed roller 34 and by the second feed roller 36. In this manner, control unit 16 can maintain an approximate count of the number of packaging cushion units produced each time that an operator commands the machine to run, e.g., so that the control unit 16 can automatically command the machine to stop when the requested number of cushion units has been produced. Other means for counting the number of cushion units produced, which will generally be more precise but also more costly, are also possible, e.g., photo-eyes, motor encoders, etc. Such devices may be employed to provide feed-back to control unit 16 regarding the number of sheets and/or cushion units that have passed a given point in machine 10.

Control unit 16 may include or be associated with a further operator input device, e.g., a switch or the like, which allows the operator to select an 'eject' mode, wherein machine 10 ejects the resultant string of packaging cushion units, e.g., into a bin or other receptacle, or a 'hold' mode, wherein machine 10 holds the last packaging cushion unit produced in a string of cushions in the outlet 66 for manual removal by the operator.

For example, with reference to FIG. 6, if the operator selects a string of about three (3) packaging cushion units 24 to be produced, and also selects the 'eject' mode, control unit 16 will command motor M3 and then M1 to discontinue operations once it (the control unit 16) determines that sheets 18*a-c* have passed through the first and second feed rollers 34, 36. In this case, the resultant series 28 of three (3) connected packaging cushion units would be ejected out of machine 10 via conveyance by second feed mechanism 14, which the control unit 16 will command to continue to operate for a predetermined time (based on speed 22 and the pre-programmed length of sheets 18) after second feed roller 36 ceases to operate.

Using the same example, if the operator selects the 'hold' mode, an additional sheet, e.g., a fourth sheet 18*d* (not shown), will be connected to sheet 18*c* (or to the last sheet to be included in the series) via an overlap 26 (also not shown), and the control unit 16 will command all motors M1-M3 to stop once that overlap has cleared the compression members 52*a, b*, such that the resultant series 28 of about three (3) connected packaging cushion units is extending from outlet 66, connected to a partially formed cushion unit formed by the next sheet (e.g., 18*d*), which is held in the machine by the compression members 52*a, b*. To remove such connected series 28, the operator simply pulls cushion unit 24*c* to release it from the overlapped connection 26 with the partially-formed cushion unit formed from the next sheet (e.g., 18*d*).

As illustrated in the drawings, second feed mechanism 14 receives sheets 18 indirectly from first feed mechanism 12, i.e., via guide plates 58*a, b*, which are interposed between the first feed mechanism 12 and the second feed mechanism 14. Alternatively, such guide plates 58*a, b* may be omitted such that the second feed mechanism 14 receives the sheets directly from the first feed mechanism 12.

As a further alternative, a machine in accordance with the present invention may include a convergence device in place of guide plates 58*a, b*. As shown in FIGS. 7-9, in alternative machine 10', at least part of convergence device 72 may be positioned between first feed mechanism 12 and second feed mechanism 14 for reducing the width dimension of the sheets 18. As shown, convergence device 72 may be in the form of a chute, with a relatively wide entrance portion 74 and a relatively narrow exit portion 76. Second feed roller 36 may be in the form of a pair of such feed rollers 36*a, b*, which may be positioned at or near the entrance portion 74 of convergence device 72, and driven by motor M1 via a common drive axle 78. With this arrangement, the first feed mechanism 12 feeds the sheets 18 into second feed mechanism 14 by pushing the sheets through the convergence device 72 and then into the second feed mechanism 14.

Exit portion 76 may be positioned adjacent the second feed mechanism 14, such that sheets 18 exiting the convergence device 72 are directed into the second feed mechanism. A guide channel 80 may extend from convergence device 72 as shown, to contain and direct the sheets 18 as they are crumpled or otherwise compressed in mechanism 14. In alternative machine 10', second feed mechanism 14 may thus be positioned within the guide channel 80, and may be driven by motor M2 via drive axle 82.

As perhaps best shown in FIG. 8, convergence device 72 may include opposing side walls 88*a, b*, which converge in a direction leading from the entrance portion 74 to the exit portion 76, i.e., along second direction 50. Side walls 88*a, b* may be included as necessary to facilitate the convergence of sheets 18 by helping to contain and direct the sheets as their width is reduced.

As also shown in FIG. 8, first feed roller 34 may comprise a pair of rollers 34*a, b*, which may be driven by motor M3 via common drive axle 84. A pair of springs 40, indicated as springs 40*a, b* in FIG. 8, may be included to bias tray base 38 towards the feed rollers 34*a, b*. Tray base 38 may be pivotally attached to the bottom 42 of tray 32 via multiple hinges 41*a-c*.

Figure 9A:
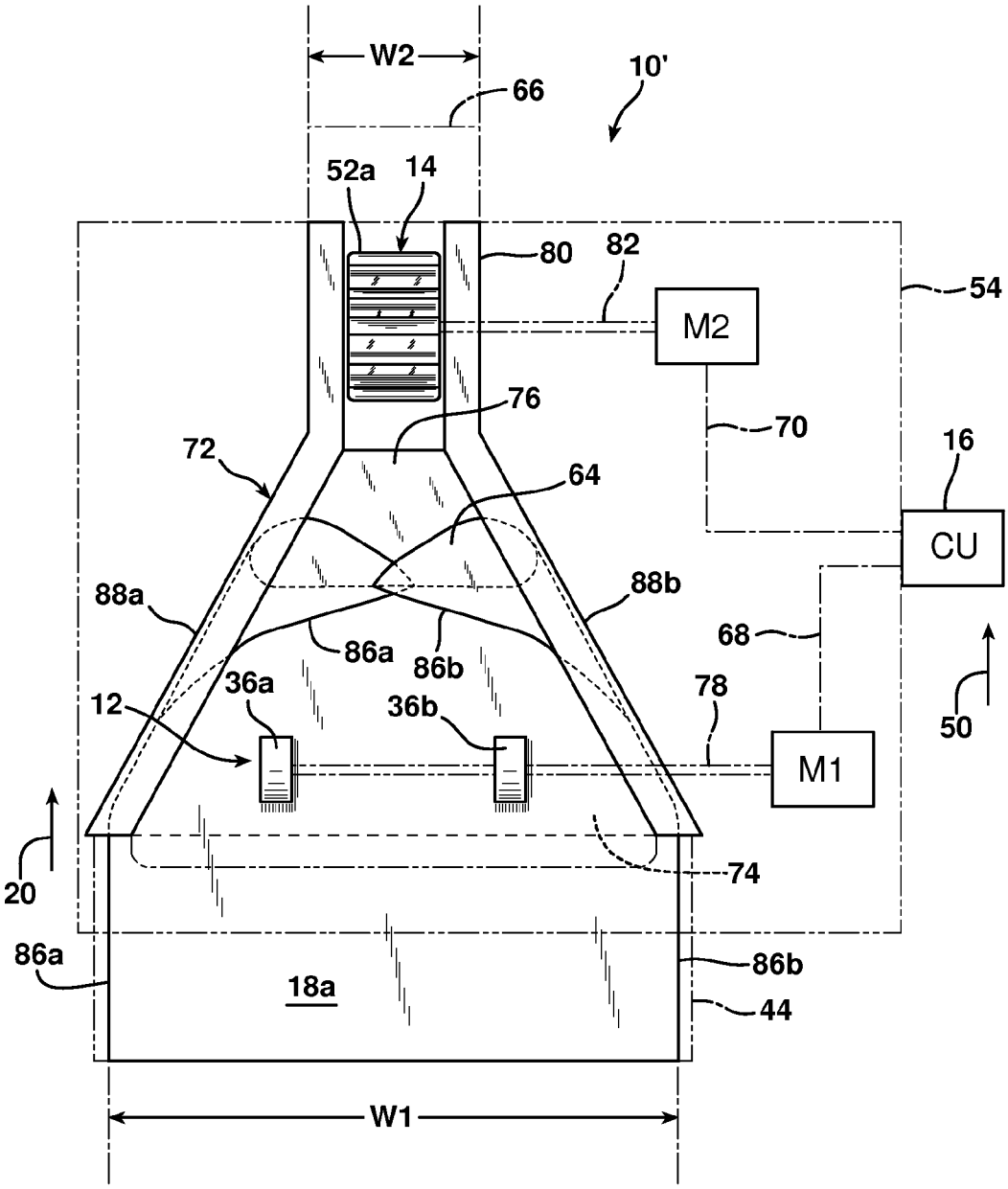
FIGS. 9A and 9B are similar to FIG. 7, and show the illustrated machine in two different stages of packaging cushion production.

FIG. 9A is essentially a plan view of FIG. 2, in that sheet 18*a* is being fed from stack 30 and into second feed mechanism 14 at first speed 20. In FIG. 9A, however, machine 10' includes convergence device 72, instead of guide plates 58*a, b*, through which sheet 18*a* is being conveyed en route to second feed mechanism 14.

As may be appreciated, sheets 18 generally have a length dimension and a width dimension, each of which may be the same or different among the various sheets in stack 30. With respect to sheet 18*a* for example, the width dimension "W1" thereof is shown in FIG. 9A; the length dimension "L" of the sheets is shown in FIG. 2. The sheets 18 generally also have a pair of opposed lateral sides 86*a, b* (FIG. 9A).

Accordingly, when alternative machine 10' is employed, i.e., with convergence device 72, the process for making packaging cushioning may further include the step of reducing the width dimension of the sheets. As shown in FIG. 9A, such width reduction step may occur prior to the crumpling/compression step in second feed mechanism 14, and may be effected by directing the sheets 18 through convergence device 72. Thus, as the sheets 18 move from the entrance portion 74 to the exit portion 76 along second direction 50, the convergence device 72 causes the lateral sides 86*a, b* to converge towards one another.

For example, as shown in FIG. 9A, the initial width W1 of sheet 18*a* may be slightly less than that of the entrance portion 74 of convergence device 72 so that the sheet can be fed into the device 72. As the sheet moves along second direction 50, the lateral sides 86*a, b* of the sheet come in contact with the convergent side walls 88*a, b*. Such convergent contact between the lateral sides 86*a, b* and the side walls 88*a, b* causes the lateral sides 86*a, b* of the sheet to converge towards one another as shown. As a result, upon reaching the exit portion 76 of the convergence device 72, and then traveling through the guide channel 80, the width of the sheet is reduced from width W1 to width W2.

The side walls 88*a, b* may be curved as shown in FIG. 8, or may have any other shape, e.g., square or rectangular, that facilitates the convergence of the lateral sides 86*a, b*. The convergence device 72 may include a bottom surface 90 as shown, and may also include a top surface (not shown), e.g., similar to upper guide plate 58*a* as shown in FIGS. 1-6 with respect to machine 10. As shown in FIGS. 7-8, cut-outs 91 in bottom surface 90 may be provided for second feed rollers 36*a, b* and backing members 46. Alternatively, both the backing members 46 and cut-outs 91 may be omitted as shown in FIGS. 9A-B, wherein feed rollers 36*a, b* drive the sheets 18 against the bottom surface 90 of convergence device 72.

Figure 9B:
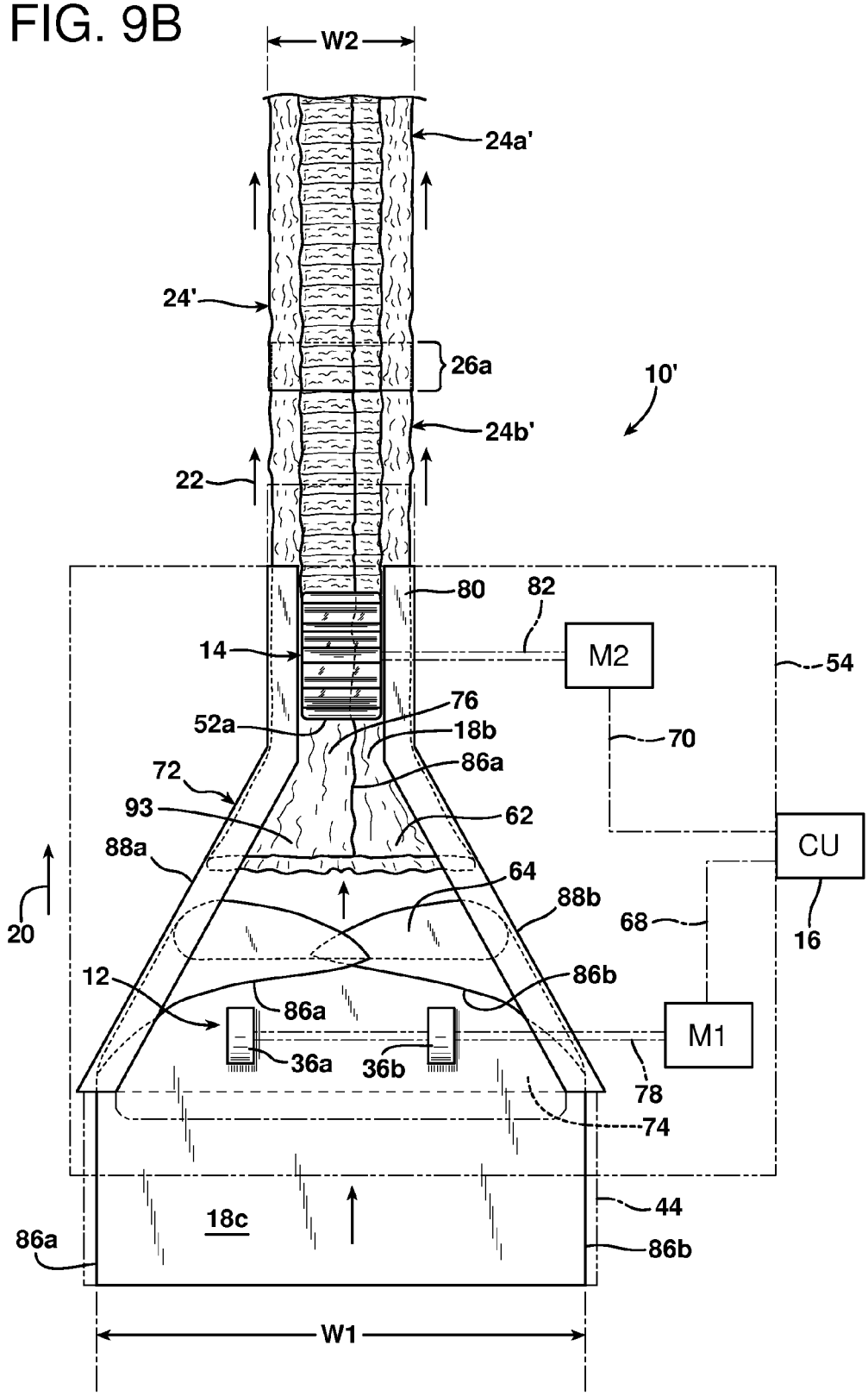

FIG. 9B is essentially a plan view of FIG. 5, except that convergence device 72 is used instead of guide plates 58*a, b*. Thus, similar to FIG. 5, in FIG. 9B the connection process between packaging cushion units 24*a'* and 24*b'*, from respective successive sheets 18*a* and 18*b*, is complete, with the overlap 26*a* between sheets 18*a, b* having moved through and past second feed mechanism 14. The remainder of sheet 18*b* is being crumpled to complete its conversion into packaging cushion unit 24*b'*. The next successive sheet 18*c* is being fed by first feed mechanism 12 at first speed 20 towards the preceding sheet 18*b*, which is moving at a slower second speed 22 as a result of its engagement by second feed mechanism 14. The speed differential between speeds 20 and 22 will result in leading end 64 of sheet 18*c* overtaking the trailing end 62 of the preceding sheet 18*b* to form another overlap 26, e.g., as shown in FIG. 6.

It may be appreciated that the shape and characteristics of packaging cushion units 24', as produced by machine 10', are different than those of packaging cushion units 24, as produced by machine 10, in that, prior to crumpling, the convergence device 72 of machine 10' reduces the width dimension W1 of sheets 18, such that the width of the resultant packaging cushion units 24 is W2. Generally, the convergence device 72 may be configured to effect any desired width reduction in sheets 18. The ratio of W1:W2 may be, for example, within the range of 10:1 to 1:1, e.g., between about 9:1 to about 2:1, such as between about 8:1 to about 3:1, 7:1 to 4:1, etc.

In the present embodiment, convergence device 72 reduces such width by causing the lateral sides 86*a, b* to converge. For example, the convergence of the lateral sides 86*a, b* may be such that the lateral sides overlap one another and form the sheets 18 into a tube 93 as shown, e.g., with only lateral side 86*a* being visible. As shown, sheet 18*b* has been formed into a tube 93, and the width thereof is being reduced as it travels towards the exit portion 76 of convergence device 72. Sheet 18*c* is in the process of being formed into a tube. The differential between its speed 20 and that of sheet 18*b* (i.e., slower speed 22) will result in leading end 64 of the tube being formed from sheet 18*c* overtaking the trailing end 62 of the tube 93 formed from preceding sheet 18*b*, which will form another overlap of the tubes, i.e., as at 26 in FIG. 9B.

In the illustrated embodiment, the final width of the packaging cushion units 24 is shown to be essentially the same as that of the outlet 66 of housing 54, i.e., W2. It should be understood, however, that this is not necessarily the case. For example, the internal structure of housing 54 can be arranged such that the final width of the packaging cushion units 24 is less than the width of the outlet 66, e.g., as would be the case if the exit portion 76 of convergence device 72 is narrower than outlet 66.

Regardless of the manner in which the lateral sides 86*a, b* are converged in device 72, as shown in FIG. 9B, the second feed mechanism 14 crimps the converged lateral sides, e.g., as the tube 93 passes through the second feed mechanism. This has the effect of causing the resultant packaging cushion unit 24' to maintain a substantially tubular, i.e., longitudinally-rolled, form.

Figure 10:
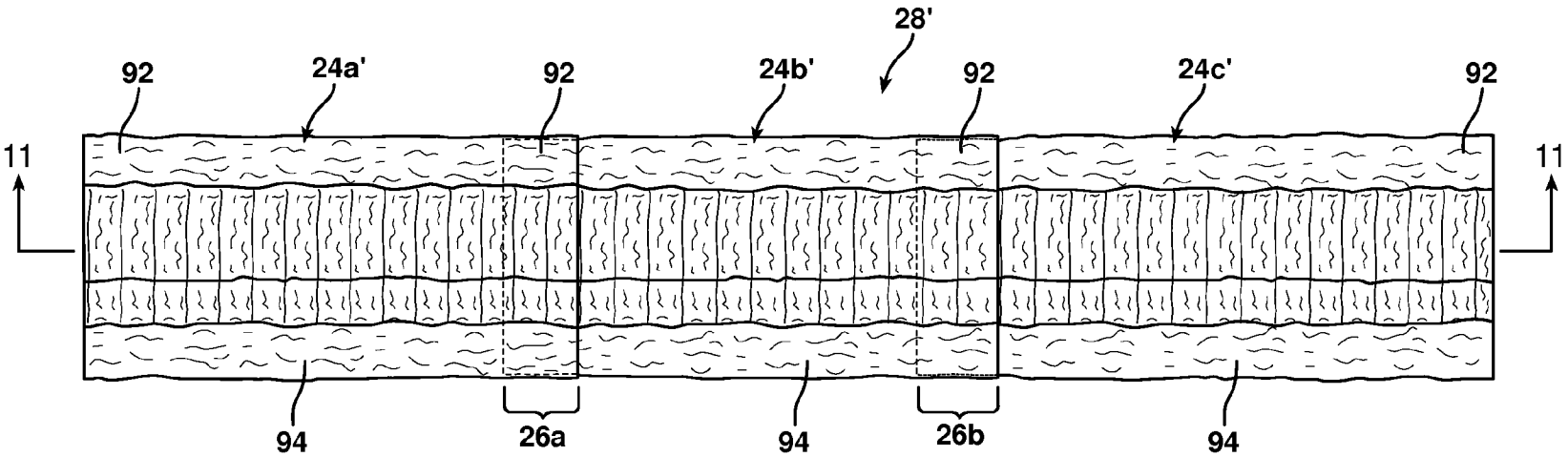
FIG. 10 is a plan view of a connected string of packaging cushion units as produced in FIG. 9B.
Figure 11:
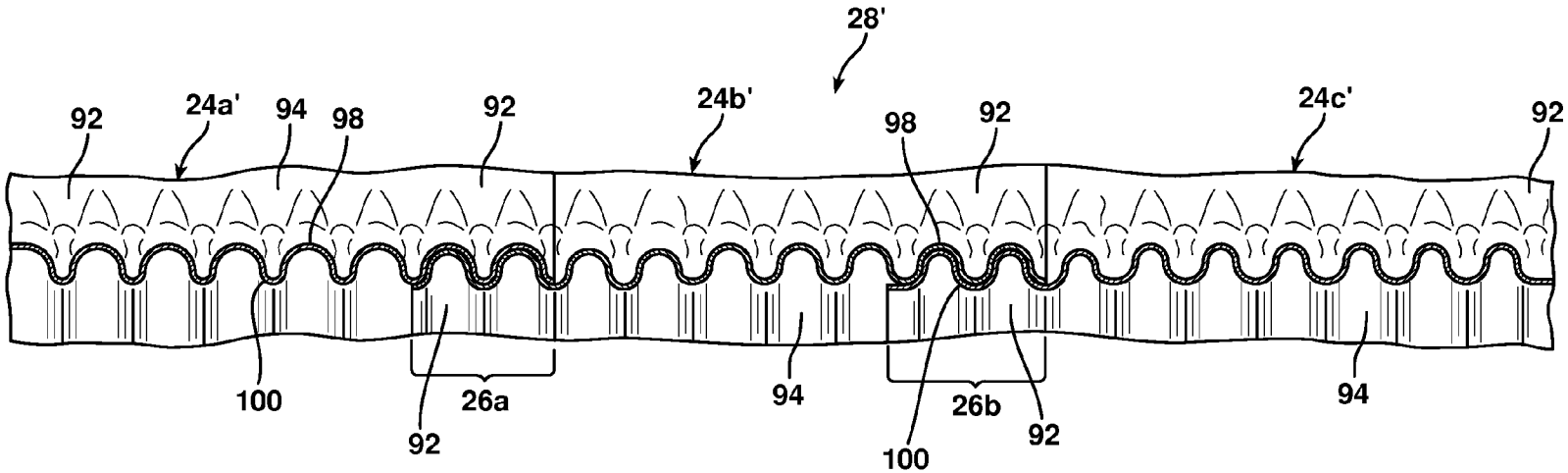
FIG. 11 a cross-sectional view of the string of packaging cushion units shown in FIG. 10, taken along lines 11-11.

Referring now to FIGS. 10-11, the packaging cushion units 24' will be described in further detail. FIGS. 10-11 show a connected series 28' of packaging cushion units 24', comprising packaging cushion units 24'*a-c*, as made from machine 10'. A greater or less number of packaging cushion units may be included in any given connected series of such cushions. Each packaging cushion unit 24' comprises a pair of end regions 92 bounding a central region 94. As shown, the end regions 92 correspond to the overlap 26 between successive sheets 18. As indicated collectively in FIGS. 9B through 11, second feed mechanism 14 crimps the overlapped end regions 92 of adjacent packaging cushion units 24' together. This has the effect of connecting the packaging cushion units 24' to thereby form the connected series 28'. Thus, in the illustration set forth in FIGS. 10-11, packaging cushion units 24*a*' and 24*b*' are connected at overlap 26*a*, while packaging cushion units 24*b*' and 24*c*' are connected at overlap 26*b*.

When machine 10' is employed, the overlapped end regions 26/92 may be formed by inserting the leading end 64 of a sheet 18, which is being formed into a tube 93, into the trailing end 62 of the preceding sheet that has already been formed into a tube 93. For example, as shown in FIG. 9B, sheet 18*c* is being formed into a tube, with the leading end 64 having a cone shape as a result of the converging side walls 88*a, b* of convergence device 72. As the sheet 18*c* moves towards the preceding sheet 18*b* at speed 20, the cone-shaped leading end 64 will be inserted into the trailing end 62 of the tube-shaped sheet 18*b*, which is moving at the slower speed 22.

Thus, the second feed mechanism 14 as employed in machine 10' crimps both of the following:

1) the converged lateral sides 86*a, b*, which has the effect of causing the resultant packaging cushion unit 24' to maintain a substantially tubular, i.e., longitudinally-rolled, shape; and 2) the overlapped end regions 26/92 of adjacent packaging cushion units 24', which has the effect of connecting the packaging cushion units 24' together as a series 28'.

Regardless of whether machine 10 or 10' is employed, the connected series 28/28' of packaging cushion units 24/24' will generally have a density that is proportional to the degree of overlap 26 between successive sheets 18. Thus, the higher the degree of the overlap 26, the higher will be the average density of the connected series 28/28' of packaging cushion units. With a higher degree of overlap, more sheets 18 will be present per unit volume of the connected series 28/28' than when the degree of overlap is less.

The degree of overlap 26 is proportional to the speed differential between the first and second speeds 20, 22. Thus, the degree of overlap 26, and therefore the density of the connected series 28/28' of packaging cushion units 24/24', may be controlled by controlling such speed differential.

Generally, the degree of overlap between any two successive sheets 18 may range from greater than 0% to less than 100%, e.g., between about 1% and about 75% overlap, between about 2% and about 50% overlap, or between about 3% and about 40% overlap, etc. For example, sheets 18 having a width "W1" of 17 inches and a length "L" of 20 inches were formed on machine 10' into a connected series 28' of packaging cushion units 24' with an overlap of about 25%, i.e., with about 5 inches of overlap between successive sheets 18, by employing a first speed 20 of about 28 inches/second and a second speed 22 of about 12 inches/second, resulting in a speed differential of about 16 inches/minute or, stated differently, a speed ratio (first speed:second speed) of 2.33:1. The initial width W1 of the sheets 18 (17 inches) was reduced to a final width W2 in the resultant packaging cushion units of 3-3.5 inches, for a W1:W2 ratio of about 5:1. The density of the resultant series 28' of packaging cushion units 24' was about 1.4 lbs/ft$^3$.

When a similar series 28' of connected packaging cushion units 24' was formed with an overlap 26 of 2 inches, i.e., a lower degree of overlap than 5 inches as in the previous example, the resultant density of the connected series 28' was also lower—namely, about 1.2 lbs/ft$^3$. In this example, the first speed 20 was about 40 inches/second and the second speed 22 was about 26 inches/second.

Figure 12:
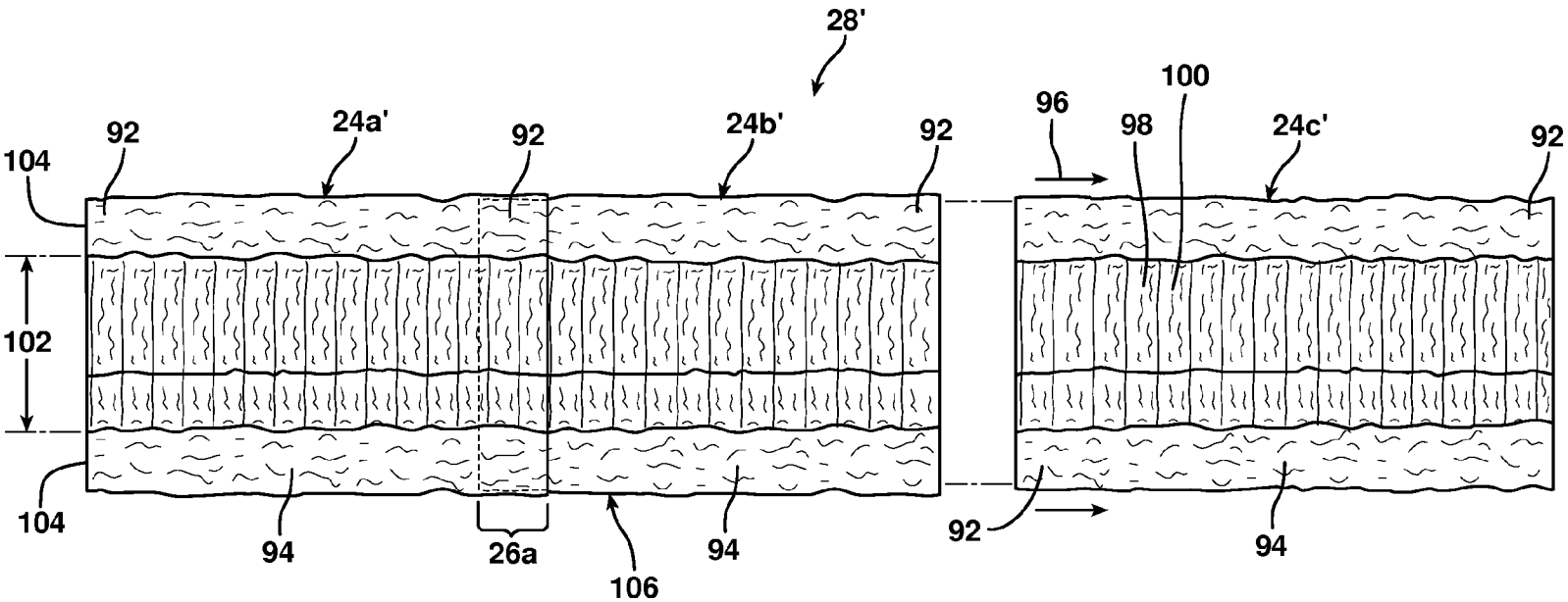
FIG. 12 is similar to FIG. 10, except one of the packaging cushion units is separated from the connected string of packaging cushion units.

Referring now to FIG. 12, a further beneficial feature of the invention will be described. Namely, in accordance with some embodiments of the invention, the packaging cushion units may be connected such that each packaging cushion unit 24/24' is slidingly separable from an adjacent packaging cushion unit 24/24'. As shown in FIG. 12, packaging cushion unit 24*c*' is being slidingly separated from connected series 28'. More specifically, packaging cushion unit 24*c*' is being slidingly separated from adjacent packaging cushion unit 24*b*' in the direction of arrows 96. This may be accomplished by connecting the cushion units 24*b*' and 24*c*' in such a way that the overlapped end regions 92 at which the two cushion units are connected, i.e., at overlap 26*b* in FIGS. 10-11, are releasable. Such releasable connection may, for example, be effected via a friction fit, which is produced by the crumpling of sheets 18 at the overlap 26 between successive sheets.

A friction fit between adjacent packaging cushion units may be achieved via the use of the second feed mechanism 14 as described above, i.e., comprising counter-rotating compression members 52*a, b*, each of which have cooperative teeth 56 that intermesh together. The intermeshing teeth 56 may be shaped and arranged to crimp the sheets 18 so as to form an alternating series of convex impressions 98 and concave impressions 100 in packaging cushion units 24', e.g., 'peaks' 98 and 'valleys' 100, as perhaps best shown in FIG. 11. The width of the compression members 52*a, b* may be substantially equal to the final width W2 of the packaging cushion units 24' so that the peaks and valleys 98, 100 extend transversely across substantially the entire width W2 of the units 24'. Alternatively, as shown in FIGS. 9A/9B, the width of the compression members 52*a, b* may be less than width W2, so that the peaks and valleys 98, 100 extend transversely across only a part of the width W2 of the packaging cushion units 24', e.g., across a center region 102 (FIG. 12), leaving longitudinally-extending outer regions 104 substantially without impressions 98, 100.

In the overlap areas 26, the peaks and valleys 98, 100 of the crimped end regions 92 of adjacent packaging cushion units 24' serve to connect the units 24' together with a friction fit, which also permits the units 24' to be slidingly separated from one another, e.g., as shown in FIG. 12. In addition to the degree of overlap 26, the coefficient of friction of sheets 18, etc., the depth of the peaks and valleys 98, 100 will determine the strength of the connection between adjacent packaging cushion units 24/24'. The depth of the peaks and valleys 98, 100, is based, at least in part, on the extent of intermeshing of the teeth 56 of counter-rotating compression members 52*a, b*. Thus, in addition to the selection of the degree of overlap 26 and the type of sheets 18, the depth of the peaks and valleys 98, 100 may be established to provide a desired amount of connection strength between adjacent packaging cushion units, so that any two units may be disconnected from one another upon the application of a desired amount of tensional force, e.g., manual force, as exerted, e.g., in the direction of arrows 96 in FIG. 12.

Advantageously, packaging cushions of any desired size, e.g., comprising a desired number of connected packaging cushion units 24/24', may be created by separating two of the packaging cushion units from one another to thereby remove a packaging cushion from the connected series 28/28' of packaging cushion units. With reference to FIG. 12, for example, a packaging cushion 106 may comprise connected packaging cushion units 24*a*' and 24*b*'. As may be appreciated, the density of packaging cushion 106 varies along its length dimension (parallel to arrows 96), with the density being higher in the overlap area 26*a* (at which the cushion units are connected) than in the remaining parts of the cushion 106. This is advantageous in packaging applications in which an object to be packaged has a relatively heavy or protruding portion; the higher density part 26 of the packaging cushion can be placed in contact with such heavy or protruding portion to provide extra support thereto.

Referring now to FIG. 13, an embodiment of control unit 16 will be described in further detail, in conjunction with, e.g., as a component of, a control system 108 for machine 10 and/or 10'. As noted above, control unit 16 controls at least one of the first and second speeds 20, 22 to produce a desired degree of overlap between successive sheets 18. As also noted, first feed mechanism 12 may include motor M1, and optionally also motor M3, to power the rotation of first feed roller 34 and/or second feed roller 36, such that the first feed mechanism 12 can successively feed sheets 18 at first speed 20 to second feed mechanism 14, which feeds the sheets at second speed 22. For simplicity, the embodiment shown in FIG. 2, i.e., wherein motor M1 powers the rotation of both first and second feed rollers 34, 36, is represented in FIG. 13.

In the embodiment schematically illustrated in FIG. 13, motor M1 receives power via power supply 110. Motor M1 is of a type that is capable of drawing a varying amount of electricity from power supply 110 when first feed mechanism 12 feeds sheets 18. For example, as first feed mechanism 12 feeds sheets 18, the power requirement of motor M1 will increase slightly each time a sheet 18 is moved forward by first feed roller 34 and by second feed roller 36, causing motor M1 to draw slightly more electricity from power supply 110 than when no sheets are being fed. Thus, when machine 10/10' feeds only one sheet 18 at a time, e.g., makes packaging cushion units from only one sheet, the amount of electricity drawn by motor M1 will vary intermittently between a 'feed amount' and a 'non-feed amount.'

On the other hand, when machine 10/10' connects packaging cushion units together by forming an overlap 26 between successive sheets, the load on motor M1 increases more than when feeding one sheet at a time, as additional force is required to push each sheet under or over a portion of the preceding sheet in the machine to form the overlap, primarily as a result of frictional resistance to such action. In this instance, the variability in the amount of electricity drawn by motor M1 will be greater than when the machine feeds only one sheet at a time, e.g., will vary, in increasing order, between a 'non-feed amount,' a 'feed amount,' and an 'overlap amount.'

As noted above, machine 10/10' can change the density of the connected series 28/28' of packaging cushion units 24/24', e.g., between a 'low-density mode,' in which a minimal degree of overlap 26 is employed, and a 'high-density mode,' in which a maximal degree of overlap is effected, with any desired density therebetween. Generally, the amount of electricity that motor M1 draws from power supply 110 will be directly proportional to the overlap/density that is created between successive sheets 18/packaging cushion units 24.

The inventors have determined that, above a certain point of overlap, e.g., in seeking to create higher-density packaging cushions, the increased resistance to forward movement of the paper sheets results in poor tracking, rippling, and then jamming of the sheets, resulting in the necessity of shutting down the machine to clear the jams. The point at which such jamming occurs can vary from machine to machine, but can be determined empirically and quantified by the amount of electricity drawn by motor M1 at the 'jamming point.'

Accordingly, control system 108 may include a sensor 112, as part of control unit 16 or as a separate component acting in conjunction with control unit 16, to measure the amount of electricity drawn by motor M1. As indicated in FIG. 13, sensor 112 may be structured and arranged to generate a signal 114, which is indicative of the amount of electricity drawn by motor M1, and communicate the signal 114 to the control unit 16. Based on signal 114, control unit 16 may thus modulate the amount of electricity that motor M1 draws from power supply 110 when the signal 114 from sensor 112 has a value that is greater than or equal to a predetermined value, e.g., wherein such predetermined value corresponds to the empirically-determined 'jamming point.'

FIG. 13 illustrates an arrangement by which the control unit 16 may modulate the amount of electricity that motor M1 draws from power supply 110, based on signal 114 from sensor 112. For example, control unit 16 may include a controller 116 and a modulating device 118 in communication with the controller 116. As shown, modulating device 118 may be positioned such that it is in electrical communication with power supply 110 for motor M1. As described in further detail below, modulating device 118 may be adapted to restrict the amount of electricity that motor M1 draws from power supply 110, based on a command 120 by controller 116.

As also illustrated in FIG. 13, power supply 110 may include an electrical connector 122, through which electricity may travel from power supply device 124 to ground 126, via supply wires 128*a*, 128*b*, 130, and motor M1. Electrical connector 122 thus allows motor M1 to receive electricity from power supply 110, i.e., via supply wire 130, which provides electrical communication between motor M1 and connector 122. In this manner, motor M1 can be 'plugged into' control system 108, to receive a desired amount of power therefrom, as will now be explained.

Controller 116 may be adapted, e.g., programmed, to cause modulating device 118 to impose a restriction on the amount of electricity that motor M1 draws from power supply 110 when the signal 114 from sensor 112 has a value that is greater than or equal to the predetermined value, e.g., a value that corresponds to the 'jamming point' for the paper sheets 18. Controller 116 may also be adapted, e.g., programmed, to remove the restriction when the signal 114 from sensor 112 has a value that is less than the predetermined value. The predetermined sensor value corresponding to the 'jamming point,' once determined empirically, i.e., through routine experimentation at a number of different density settings, can be programmed into the controller 116. As is conventional, e.g., when controller 116 is a microcontroller, a PLC, a PAC, etc., the predetermined input value from sensor 112 corresponding to the jamming point can be programmed into the controller during initial programming as part of the written source code; this value may be changed as desired by an ordinarily-skilled technician, e.g., via an interface device that may be connected directly or indirectly to controller 116. As is also conventional, controller 116 may be part of a printed circuit board (PCB), which may include some or all of the components illustrated in FIG. 13. For example, the control system 108 may be in the form of a PCB, e.g., as a subassembly within a larger PCB, which controls/monitors all or most of the components of machine 10 or 10'.

As illustrated in FIG. 13, sensor 112 may include a current-sensing resistor 132 in electrical communication with power supply 110, and a signal-generating device 134, which generates signal 114 based upon the current sensed by resistor 132, i.e., in power supply 110. The signal-generating device 132 may include an integrated circuit and additional devices, e.g. resistors and capacitors, as necessary to generate signal 114, which may be in the form of a an electric current and read by controller 116 as amperage or voltage. As an example, when power supply device generates 24 volts of direct current (DC), and motor M1 is a DC motor that can draw current ranging from 0 to 5 amperes (A), the signal-generating device 134 may be calibrated such that the signal 114 generated by the device 134 ranges from 0-1.62 volts (V), with 0 (zero) V corresponding to 0 (zero) A drawn by motor M1, and 1.62 V corresponding to 5 A drawn by motor M1. If it is determined, e.g., empirically, that a current draw of 2.3 A by motor M1 is the 'jamming point,' i.e., indicates that the overlap 26 being formed between successive sheets 18 is such that paper jamming is imminent or probable, and this corresponds to a signal value 114 of 0.75 V, then 0.75 V can be programmed into controller 116 as the predetermined value at which to impose a restriction on the amount of electricity that motor M1 can draw from power supply 110.

In some embodiments, modulating device 118 may be adapted to restrict the amount of electricity that motor M1 can draw from power supply 110 by simply reducing the amount of current that can flow through the device 118, i.e., upon command by controller 116. When device 118 is arranged in series with power supply 110 with connector 122 as shown, this will effectively reduce the amount of current that motor M1 can draw. Modulating device 118 may function in this manner when embodied, e.g., as an adjustable power supply device, such as an adjustable DC/DC converter. With such embodiment, modulating device 118 and power supply device 124 could be combined into a single device and positioned, e.g., where power supply device 124 is located in FIG. 13.

In other embodiments, modulating device 118 may be adapted to restrict the amount of electricity that motor M1 can draw from power supply 110 by 1) imposing upper and lower limits on the amount of electricity that motor M1 draws from power supply 110, based on a command by controller 116, and then 2) oscillating between the upper and lower limits at predetermined intervals, as also commanded by controller 116. In this manner, the current supplied to motor M1 pulses between the upper and lower limits, which causes the force exerted by motor M1 on sheets 18 to also pulse, thereby reducing the tendency for the sheets to become misaligned and jam. In order to perform this function, modulating device 118 may be embodied by a switching device, such as a field-effect transistor (FET), a bipolar junction transistor (BJT), or other electrical device that can switch at a desired frequency and withstand the voltage/current requirements of motor M1.

Accordingly, by measuring the amount of electricity drawn by motor M1, comparing this to a predetermined value indicative of the onset of the 'jamming point,' and then modulating the amount of electricity that motor M1 can draw once the jamming point is reached, a desired degree of overlap 26, leading to a desired packaging-cushion density, can still be achieved, but with a reduced likelihood of sheet misalignment and jamming.

EXAMPLE

With reference to FIGS. 7 and 13, machine 10' was constructed and sized to convert sheets 18, which comprised paper having a width of 17 inches and a length of 20 inches, into packaging cushions 106. The machine included a control system 108 with the following components:

1) Motor M1 was a DC Brush-Gearmotor, GM 9000 Series from Pittman Corp., with a 5.9:1 ratio and 48 oz-in continuous torque.

2) Power supply device 124 was an AC/DC converter that converts AC voltage to 24 volts DC; the device was a model SP-320-24 Switching Power Supply from Meanwell Corp., Universal AC Input (88 to 264V AC), 50/60 Hz, which converts AC voltage to 24 VDC @ 13 A.

3) Modulating device 118 included a FET and a FET driver, wherein the FET driver received commands from the controller 116 and actuated the switching action of the FET. The FET was a model IRLZ44ZPBF from International Rectifier Corp., with the following characteristics: N-channel, TO-220, logic level, Vdss=55V. The FET driver was a model MCP1407-E/SN from Microchip Corp., with the following characteristics: IC (integrated circuit), 6A, 8-SOIC, non-inverting.

4) Controller 116 was a model MC9S12A256CPVE microcontroller from Freescale Corp., which was an IC-type MCU, 256K flash, 16 bit device.

5) Sensor 112 included a model MAX4172EUA+ type IC from Maxim Corp., with an amplifier and 8-Umax package, as the signal-generating device 134. The current-sensing resistor 132 was a model MSR-5 resistor from Riedon Corp., with the following characteristics: 0.01 ohm, 5W 1% bare element. A resistor and capacitor were situated in parallel to ground to receive the output from signal-generating device 134, which converted signal 114 to one ranging from 0 to 1.62 volts.

Machine 10' was operated at a number of different conditions to produce a range of densities for the resultant packaging cushions 106, until it was determined that a motor M1 draw of 2.3 A was the jamming point, i.e., indicted the imminent or probable onset of a paper jam by sheets 18. The value of signal 114 from sensor 112 corresponding to a motor draw of 2.3 A was 0.75 volts, and this was programmed into controller 116 as the predetermined value at which to initiate modulation of the amount of electricity that motor M1 thereafter draws.

During all periods when sensor 112 detected that motor M1 was drawing less than 2.3 A, controller 116 sent a command 120 to modulating device 118, which resulted in the operation of the modulating device such that motor M1 was allowed to draw 24 V of electricity from power supply 110 in a pulsed fashion at 50-microsecond intervals, with full power (24 V) for 32.5 microseconds (65% of each interval) and zero power (0 V) for 17.5 microseconds (35% of each interval). This was a 'normal duty' pulse rate.

When sensor 112 detected that motor M1 was drawing 2.3 A or more, controller 116 altered command 120 such that modulating device 118 imposed a restriction on the amount of electricity drawn by the motor. This was accomplished by cycling, every 10 milliseconds, between the 'normal duty' pulse rate as described immediately above, and a 'low duty' pulse rate, in which modulating device 118 allowed motor M1 to draw full power for 20 microseconds (40% of each 50 microsecond interval) and zero power for 30 microseconds (60% of each interval). This restriction, i.e., cycling every 10 milliseconds between the normal and low duty pulse rates, continued until the detected draw rate of motor M1 fell below 2.3 A, at which point modulating device 118 reverted to the 'normal duty' pulse rate for motor M1, by way of command 120 from controller 116.

When operated in the foregoing manner, machine 10' was able to produce packaging cushions 106 of various densities while avoiding about 95% of all paper jams that would otherwise have been caused by overlaps 26.

The foregoing description of preferred embodiments of the invention has been presented for purposes of illustration and description. It is not intended to be exhaustive or to limit the invention to the precise form disclosed, and modifications and variations are possible in light of the above teachings or may be acquired from practice of the invention.

What is claimed is:

1. A machine for producing packaging cushioning, comprising:

a. a first feed mechanism for successively feeding sheets of a substrate at a first speed, said first feed mechanism including a motor and a power supply therefor, wherein said motor is capable of drawing a varying amount of electricity from said power supply when said first feed mechanism feeds said sheets;

b. a second feed mechanism for receiving said sheets from said first feed mechanism and feeding said sheets at a second speed;

c. a control unit for controlling at least one of said first and second speeds to produce a desired degree of overlap between successive sheets; and d. a sensor to measure the amount of electricity drawn by said motor, said sensor being structured and arranged to generate a signal, which is indicative of the amount of electricity drawn by said motor, and communicate said signal to said control unit, wherein, said control unit is structured and arranged to modulate the amount of electricity that said motor draws from said power supply when said signal from said sensor has a value that is greater than or equal to a predetermined value.

2. The machine of claim 1, wherein said second feed mechanism is a crumpling mechanism, which converts said sheets into packaging cushion units.

3. The machine of claim 2, wherein said machine is configured to connect the packaging cushion units together in series, and the connected series of packaging cushion units has a density that is proportional to said degree of overlap between successive sheets.

4. The machine of claim 3, wherein said crumpling mechanism comprises a pair of compression members that connect said packaging cushion units together by crumpling the sheets at said overlap between successive sheets.

5. The machine of claim 3, wherein:

said sheets have a length dimension and a width dimension; and said machine further includes a convergence device, at least part of which is positioned between said feed mechanism and said crumpling mechanism for reducing the width dimension of the sheets.

6. The machine of claim 5, wherein:

said sheets have a pair of opposed lateral sides;

said convergence device causes said lateral sides to converge towards one another; and said crumpling mechanism crimps said converged lateral sides.

7. The machine of claim 6, wherein:

each packaging cushion unit comprises a pair of end regions bounding a central region;

said end regions correspond to said overlap between successive sheets;

said convergence device causes said lateral sides to converge towards one another within said end regions; and said crumpling mechanism crimps the end regions of adjacent cushion units together, thereby connecting said packaging cushion units together.

8. The machine of claim 2, wherein said crumpling mechanism comprises a pair of compression members that convert the sheets into packaging cushion units by compressing the sheets therebetween.

9. The machine of claim 1, wherein:

said first speed is greater than said second speed; and said degree of overlap between any two successive sheets ranges from greater than 0% to less than 100%.

10. The machine of claim 1, wherein said packaging cushion units are connected such that each packaging cushion unit is slidingly separable from an adjacent packaging cushion unit.

11. The machine of claim 1, wherein said packaging cushion units are connected together via a friction fit, which is produced by said crumpling of said sheets at said overlap between successive sheets.

12. The machine of claim 1, wherein:

said control unit includes a controller and a modulating device in communication with said controller; and said modulating device is in electrical communication with said power supply for said motor, and is adapted to restrict the amount of electricity that said motor draws from said power supply, based on a command by said controller.

13. The machine of claim 12, wherein said modulating device is further adapted to:

impose upper and lower limits on the amount of electricity that said motor draws from said power supply, based on a command by said controller; and oscillate between said upper and lower limits at predetermined intervals as commanded by said controller.

14. The machine of claim 12, wherein said controller is adapted to cause said modulating device to:

impose said restriction on the amount of electricity that said motor draws from said power supply when said signal from said sensor has a value that is greater than or equal to said predetermined value; and remove said restriction when said signal from said sensor has a value that is less than said predetermined value.

15. The machine of claim 1, wherein said sensor comprises:

a current-sensing resistor in electrical communication with said power supply; and a signal-generating device, which generates said signal based upon the current sensed by said resistor.

* * * * *